US006331230B1

(12) United States Patent
Hermans et al.

(10) Patent No.: US 6,331,230 B1
(45) Date of Patent: Dec. 18, 2001

(54) METHOD FOR MAKING SOFT TISSUE

(75) Inventors: Michael Alan Hermans, Neenah; Mark Alan Burazin; Frank Stephen Hada, both of Appleton; Sung Ho Hong, Neenah, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/558,002

(22) Filed: Apr. 24, 2000

Related U.S. Application Data

(62) Division of application No. 08/961,914, filed on Oct. 31, 1997, now Pat. No. 6,149,767.

(51) Int. Cl.[7] ..... D21F 3/00

(52) U.S. Cl. ..... 162/207; 162/109; 162/111

(58) Field of Search ..... 162/109, 111, 162/112, 113, 117, 206, 204, 115, 207, 208, 209, 210, 297, 301, 308

(56) References Cited

U.S. PATENT DOCUMENTS

| | | | |
|---|---|---|---|
| 1,297,192 | 3/1919 | Repman . | |
| 1,718,573 | 6/1929 | Millspaugh . | |
| 2,091,805 | 8/1937 | Chuse . | |
| 2,861,354 | 11/1958 | Hultgreen . | |
| 2,926,116 | 2/1960 | Keim . | |
| 3,052,991 | 9/1962 | Goldner . | |
| 3,058,873 | 10/1962 | Keim et al. . | |
| 3,084,448 | 4/1963 | Dungler . | |
| 3,176,412 | 4/1965 | Gardner . | |
| 3,208,158 | 9/1965 | Smith, Jr. . | |
| 3,220,914 | 11/1965 | Boadway et al. . | |
| 3,224,926 | 12/1965 | Bernardin . | |
| 3,224,928 | 12/1965 | Lee et al. . | |
| 3,284,285 | 11/1966 | Holden . | |
| 3,303,576 | 2/1967 | Sisson . | |
| 3,319,354 | 5/1967 | Hering, Jr. et al. . | |
| 3,340,617 | 9/1967 | Carroll, Jr. . | |
| 3,371,427 | 3/1968 | Thygeson, Sr. . | |
| 3,434,922 | 3/1969 | Ely . | |
| 3,447,247 * | 6/1969 | Daane | 162/115 |
| 3,455,778 | 7/1969 | Bernardin . | |
| 3,537,954 | 11/1970 | Justus . | |
| 3,541,697 | 11/1970 | Villalobos . | |
| 3,574,261 | 4/1971 | Bailey . | |
| 3,577,651 | 5/1971 | Nichols . | |
| 3,587,177 | 6/1971 | Overly et al. . | |
| 3,599,341 | 8/1971 | Darcy et al. . | |
| 3,607,624 | 9/1971 | Moody et al. . | |
| 3,617,442 | 11/1971 | Hurschman . | |

(List continued on next page.)

FOREIGN PATENT DOCUMENTS

| | | |
|---|---|---|
| 677083 | 12/1963 | (CA) . |
| 0 033 559 A3 | 8/1981 | (EP) . |
| 0 328 227 A2 | 8/1989 | (EP) . |

(List continued on next page.)

OTHER PUBLICATIONS

Bieman, Leonard H., Kevin G. Harding, and Albert Boehnlein, "Absolute Measurement Using Field Shifted Moiré," Optics, Illumination, and Image Sensing for Machine Vision VI, SPIE Proceedings Series, Nov. 14–15, 1991, vol. 1614, pp. 259–264.

(List continued on next page.)

*Primary Examiner*—Peter Chin
(74) *Attorney, Agent, or Firm*—Patricia A. Charlier

(57) ABSTRACT

An uncreped tissue sheet having improved softness results from supplementally dewatering a wet web to a consistency of greater than about 30 percent using noncompressive dewatering techniques prior to a differential speed transfer and subsequent throughdrying. An air press particularly well suited for providing the supplemental noncompressive dewatering incorporates side and/or end seals to minimize escape of pressurized fluid. A creped tissue sheet can be produced with a variety of manufacturing benefits using the air press.

17 Claims, 16 Drawing Sheets

U.S. PATENT DOCUMENTS 3,629,056 12/1971 Forrest .
3,729,376 4/1973 Stevens .
3,771,236 11/1973 Candor et al. .
3,771,239 11/1973 Minoda et al. .
3,810,818 5/1974 Arledter .
3,812,598 5/1974 Lefebvre et al. .
3,822,182 7/1974 Heyse et al. .
3,844,881 10/1974 Moody .
3,849,904 11/1974 Villalobos .
3,895,449 7/1975 Chance et al. .
3,913,241 10/1975 Chaikin et al. .
3,923,593 12/1975 Verseput .
3,930,319 1/1976 Coleman .
3,994,771 * 11/1976 Morgan, Jr. et al. ..... 162/113
4,072,557 2/1978 Schiel .
4,074,441 2/1978 Helversen et al. .
4,102,737 7/1978 Morton .
4,120,747 10/1978 Sarge, III et al. .
4,121,968 10/1978 Wells .
4,125,430 11/1978 Grossman .
4,157,938 * 6/1979 Clemens et al. ..... 162/207
4,163,688 8/1979 Kankaanpaa .
4,183,147 1/1980 Kawaguchi .
4,197,973 4/1980 Daane .
4,201,323 5/1980 Stibbe et al. .
4,309,246 1/1982 Hulit et al. .
4,345,385 8/1982 Sando et al. .
4,356,059 10/1982 Hostetler .
4,361,466 11/1982 Wong et al. .
4,364,185 12/1982 Dussourd et al. .
4,421,600 12/1983 Hostetler .
4,440,597 4/1984 Wells et al. .
4,462,868 7/1984 Oubridge et al. .
4,528,316 7/1985 Soerens .
4,529,480 7/1985 Trokhan .
4,541,895 9/1985 Albert .
4,551,199 11/1985 Weldon .
4,556,450 12/1985 Chuang et al. .
4,559,105 12/1985 Sennett et al. .
4,571,359 2/1986 Dutt .
4,637,859 1/1987 Trokhan .
4,787,641 11/1988 Rautakorpi et al. .
4,835,880 6/1989 Vecchia .
4,849,054 7/1989 Klowak .
4,871,425 10/1989 Gunderson .
4,888,096 12/1989 Cowan et al. .
4,892,622 1/1990 Malkki et al. .
4,915,788 4/1990 Winheim .
4,953,297 9/1990 Eskelinen et al. .
4,976,821 12/1990 Laapotti .
4,986,009 1/1991 Haessner et al. .
5,043,046 8/1991 Laapotti .
5,048,589 9/1991 Cook et al. .
5,070,627 12/1991 Zagar .
5,070,628 12/1991 Zagar .
5,078,835 1/1992 Schiel et al. .
5,085,737 2/1992 Brogyanyi et al. .
5,105,562 4/1992 Hella et al. .
5,129,988 7/1992 Farrington, Jr. .
5,137,600 8/1992 Barnes et al. .
5,149,401 9/1992 Langevin et al. .
5,187,219 2/1993 Furman, Jr. .
5,225,042 7/1993 Eaton et al. .
5,230,776 7/1993 Andersson et al. .
5,262,010 11/1993 Bubik et al. .
5,274,930 1/1994 Ensign et al. .
5,336,373 8/1994 Scattolino et al. .
5,348,620 9/1994 Hermans et al. .
5,381,580 1/1995 Kotitschke et al. .
5,411,636 5/1995 Hermans et al. .
5,429,686 7/1995 Chiu et al. .
5,471,765 12/1995 Rautakorpi et al. .
5,490,903 2/1996 Chen et al. .
5,501,768 3/1996 Hermans et al. .
5,508,095 4/1996 Allum et al. .
5,556,053 9/1996 Henseler .
5,598,643 2/1997 Chuang et al. .
5,601,871 2/1997 Krzysik et al. .
5,607,551 3/1997 Farrington, Jr. et al. .
5,611,893 3/1997 Pajula et al. .
5,620,566 4/1997 Holopainen .
5,625,961 5/1997 Ensign et al. .
5,656,132 8/1997 Farrington, Jr. et al. .
5,667,636 9/1997 Engel et al. .
5,743,999 4/1998 Kamps et al. .
5,746,887 5/1998 Wendt et al. .
5,772,845 6/1998 Farrington, Jr. et al. .
5,830,321 11/1998 Lindsay et al. .
5,990,377 11/1999 Chen et al. .
6,080,279 6/2000 Hada et al. .
6,080,691 6/2000 Lindsay et al. .
6,083,346 7/2000 Hermans et al. .
6,093,284 7/2000 Hada et al. .
6,096,169 8/2000 Hermans et al. .
6,120,642 9/2000 Lindsay et al. .
6,143,135 11/2000 Hada et al. .
6,149,767 11/2000 Hermans et al. .

FOREIGN PATENT DOCUMENTS 0 502 602 A1 9/1992 (EP) .
0 574 366 A1 12/1993 (EP) .
0 616 074 A1 9/1994 (EP) .
679469 4/1930 (FR) .
1235868 5/1960 (FR) .
2 303 116 10/1976 (FR) .
1057373 2/1967 (GB) .
2 152 961 A 8/1985 (GB) .
2 179 949 A 3/1987 (GB) .
2 179 953 A 3/1987 (GB) .
2 235 754 A 3/1991 (GB) .
2 254 288 B 10/1992 (GB) .
WO 90/04676 A1 5/1930 (WO) .
WO 91/16493 A1 10/1991 (WO) .
WO 93/23616 A1 11/1993 (WO) .
WO 95/00706 A1 1/1995 (WO) .
WO 97/43483 A1 11/1997 (WO) .
WO 97/43484 A1 11/1997 (WO) .
WO 99/23300 A1 5/1999 (WO) .

OTHER PUBLICATIONS

Bowden, Edward V., "Non–Contact Drying and Turning—the 'On Machine' Technology of the Nineties," Appita, vol. 44, No. 1, Jan. 1991, pp. 41–46.

Haberl, Andrew et al., "First Linerboard Application Of The Gas Heated Paper Dryer," 45th Appita Annual General Conference Proceedings, vol. 1, 1991, pp. 47–50.

Kufferath, W. et al., "Die Sonic–Roll," Das Papier, 42(10A): V140, 1988.

Lindsay, Jeffrey D. and Leonard H. Bieman, "Exploring Tactile Properties of Tissue With Moire Interferometry," Non–Contact, Three–Dimensional Gaging Methods and Technologies Workshop, Dearborn, Michigan, Mar. 1997.

Lindsay, Jeffrey D., "Displacement Dewatering To Maintain Bulk," Paperi Ja Puu—Paper And Timber, vol. 74, No. 3, 1992, pp. 232–242.

Mummery, Leigh, Surface Texture Analysis: The Handbook, published by Hommelwerke GmbH, Muhlhausen, Germany, 1990, pp. 37–45.

Page,R.H. and J. Seyed–Yagoobi, "A New Concept For Air Or Vapor Impingement Drying," Tappi Journal, 73(9), Sep. 1990, pp. 229–234.

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

TAPPI Useful Method UM 256, "Water Retention Value (WRV)," published by the TAPPI Press, Atlanta, Georgia, pp. 54–56.

Thiele, P.E. and R.H. Page, "Enhancement Of Drying Rate, Moisture Profiling And Sheet Stability On A Existing Paper Machine With RJR Blow Boxes," 1995 Papermakers Conference, Tappi Press, Atlanta, Georgia,1995, pp.223–228.

* cited by examiner

METHOD FOR MAKING SOFT TISSUE

This application is a divisional of application Ser. No. 08/961,914 filed on Oct. 31, 1997, now U.S. Pat. No. 6,149,767.

BACKGROUND OF THE INVENTION

There are many characteristics of tissue products such as bath and facial tissue that must be considered in producing a final product having desirable attributes that make it suitable and preferred for the product's intended purpose. Improved softness of the product has long been one major objective, and this has been a particularly significant factor for the success of premium products. In general, the major components of softness include stiffness and bulk (density), with lower stiffness and higher bulk (lower density) generally improving perceived softness.

While enhanced softness is a desire for all types of tissue products, it has been especially challenging to achieve softness improvements in uncreped throughdried sheets. Throughdrying provides a relatively noncompressive method of removing water from a web by passing hot air through the web until it is dry. More specifically, a wet-laid web is transferred from the forming fabric to a coarse, highly permeable throughdrying fabric and retained on the throughdrying fabric until dry. The resulting dried web is softer and bulkier than a conventionally-dried uncreped sheet because fewer bonds are formed and because the web is less compressed. Thus, there are benefits to eliminating the Yankee dryer and making an uncreped throughdried product. Uncreped throughdried sheets are typically quite harsh and rough to the touch, however, compared to their creped counterparts. This is partially due to the inherently high stiffness and strength of an uncreped sheet, but is also due in part to the coarseness of the throughdrying fabric onto which the wet web is conformed and dried.

Moreover, from a manufacturing perspective, the throughdrying process is relatively energy intensive and therefore expensive compared to wet pressing. The high temperatures required for the throughdrying process also detrimentally affects the useful life of fabrics used in the manufacturing process.

Therefore, what is lacking and needed in the art is a method for manufacturing tissue products having improved softness, and in particular throughdried tissue products having improved softness, as well as a more economical method for manufacturing throughdried tissue products.

SUMMARY OF THE INVENTION

It has now been discovered that an improved uncreped throughdried web can be made by dewatering the web to greater than about 30 percent consistency prior to transferring the wet web from a forming fabric to one or more slower speed intermediate transfer fabrics before further transferring the web to a throughdrying fabric for final drying of the web. In particular, increasing the consistency of the uncreped throughdried web before the point of differential speed transfer has surprisingly been found to result in: (1) both higher machine direction and cross direction tensile properties, contributing to improved runnability of the web; and (2) reduced modulus, that is increased softness, when the tensile strength is adjusted to the normal value. This discovery allows for the manufacture of tissue products with lower modulus at given tensile strengths as compared even to tissue products produced by undergoing differential speed transfer at lower consistencies.

Hence, in one aspect the invention resides in a method of making a soft tissue sheet. The method includes the steps of: depositing an aqueous suspension of papermaking fibers onto an endless forming fabric to form a wet web; dewatering the wet web to a consistency of from about 20 to about 30 percent; supplementally dewatering the wet web using noncompressive dewatering means to a consistency of greater than about 30 percent; transferring the supplementally dewatered web to a transfer fabric traveling at a speed of from about 10 to about 80 percent slower than the forming fabric; transferring the web to a throughdrying fabric; and throughdrying the web to a final dryness.

One particularly desirable means by which the web can be dewatered to about 30 percent consistency or greater comprises an air press located just upstream of the differential speed transfer. While pressurized fluid jets in combination with a vacuum device have previously been discussed in the patent literature, such devices have not been widely used in tissue manufacturing. Principally, this appears to be due to the fact that it had not been previously recognized that dewatering the web to greater than about 30 percent consistency in advance of the differential speed transfer would result in the improved product properties identified herein. Moreover, the disincentive to using such equipment is also believed to be attributable to the difficulties of actual implementation, including disintegration of the tissue web, pressurized fluid leaks, seal and/or fabric wear, and the like. The air press disclosed herein overcomes these difficulties and provides a practical apparatus for dewatering a wet web to consistency levels not previously thought possible at industrially useful speeds without thermal dewatering.

The intermediate transfer fabric or fabrics are traveling at a slower speed than the forming fabric during the transfer in order to impart stretch into the sheet. As the speed differential between the forming fabric and the slower transfer fabric is increased (sometimes referred to as "negative draw" or "rush transfer"), the stretch imparted to the web during transfer is also increased. The transfer fabric can be relatively smooth and dense compared to the coarse weave of a typical throughdrying fabric. Preferably the transfer fabric is as fine as can be run from a practical standpoint. Gripping of the web is accomplished by the presence of knuckles on the surface of the transfer fabric. In addition, it can be advantageous if one or more of the wet web transfers, with or without the presence of a transfer fabric, are achieved using a "fixed gap" or "kiss" transfer in which the fabrics simultaneously converge and diverge, which will be hereinafter described in detail. Such transfers not only avoid any significant compaction of the web while it is in a wet bond-forming state, but when used in combination with a differential speed transfer and/or a smooth transfer fabric, are observed to smoothen the surface of the web and final dry sheet.

The speed difference between the forming fabric and the transfer fabric can be from about 10 to about 80 percent or greater, preferably from about 10 to about 35 percent, and more preferably from about 15 to about 25 percent, with the transfer fabric being the slower fabric. The optimum speed differential will depend on a variety of factors, including the particular type of product being made. As previously mentioned, the increase in stretch imparted to the web is proportional to the speed differential. For an uncreped throughdried three-ply wiper having a basis weight of about 20 grams per square meter per ply, for example, a speed differential in the production of each ply of from about 20 to about 25 percent between the forming fabric and a sole transfer fabric produces a stretch in the final product of from about 15 to about 20 percent.

The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The transfer is desirably carried out such that the resulting "sandwich" (consisting of the forming fabric/web/transfer fabric) exists for as short a duration as possible. In particular, it exists only at the leading edge of the vacuum shoe or transfer shoe slot being used to effect the transfer. In effect, the forming fabric and the transfer fabric converge and diverge at the leading edge of the vacuum slot. The intent is to minimize the distance over which the web is in simultaneous contact with both fabrics. It has been found that simultaneous convergence/divergence is the key to eliminating macrofolds and thereby enhances the smoothness of the resulting tissue or other product.

In practice, the simultaneous convergence and divergence of the two fabrics will only occur at the leading edge of the vacuum slot if a sufficient angle of convergence is maintained between the two fabrics as they approach the leading edge of the vacuum slot and if a sufficient angle of divergence is maintained between the two fabrics on the downstream side of the vacuum slot. The minimum angles of convergence and divergence are about 0.5 degree or greater, more specifically about 1 degree or greater, more specifically about 2 degrees or greater, and still more specifically about 5 degrees or greater. The angles of convergence and divergence can be the same or different. Greater angles provide a greater margin of error during operation. A suitable range is from about 1 degree to about 10 degrees. Simultaneous convergence and divergence is achieved when the vacuum shoe is designed with the trailing edge of the vacuum slot being sufficiently recessed relative to the leading edge to permit the fabrics to immediately diverge as they pass over the leading edge of the vacuum slot. This will be more clearly described in connection with the Figures.

In setting up the machine with the fabrics initially having a fixed gap to further minimize compression of the web during the transfer, the distance between the fabrics should be equal to or greater than the thickness or caliper of the web so that the web is not significantly compressed when transferred at the leading edge of the vacuum slot.

Increased smoothness is achieved by use of the air press upstream of the differential speed transfer. This is most preferably used in combination with a fixed gap carrier fabric section following drying. Calendering of the web is not necessary to obtain desirable levels of smoothness, but further processing of the sheet, such as by calendering, embossing or creping, may be beneficial to further enhance the sheet properties.

As used herein, "transfer fabric" is a fabric which is positioned between the forming section and the drying section of the web manufacturing process. Suitable transfer fabrics are those papermaking fabrics which provide a high fiber support index and provide a good vacuum seal to maximize fabric/sheet contact during transfer from the forming fabric. The fabric can have a relatively smooth surface contour to impart smoothness to the web, yet must have enough texture to grab the web and maintain contact during a rush transfer. Finer fabrics can produce a higher degree of stretch in the web, which is desirable for some product applications.

Transfer fabrics include single-layer, multi-layer, or composite permeable structures. Preferred fabrics have at least some of the following characteristics: (1) On the side of the transfer fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional characteristic; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yams.

Specific suitable transfer fabrics include, by way of example, those made by Asten Forming Fabrics, Inc., Appleton, Wis. and designated as numbers 934, 937, 939 and 959. Particular transfer fabrics that may be used also include the fabrics disclosed in U.S. Pat. No. 5,429,686 issued Jul. 4, 1995, to Chiu et al., which is incorporated herein by reference. Suitable fabrics may comprise woven fabrics, nonwoven fabrics, or nonwoven-woven composites. The void volume of the transfer fabric can be equal to or less than the fabric from which the web is transferred.

An air press as disclosed herein is able to dewater the wet web to very high consistencies due in large part to the high pressure differential established across the web and the resulting air flow through the web. In particular embodiments, for example, the air press can increase the consistency of the wet web by about 3 percent or greater, particularly about 5 percent or greater, such as from about 5 to about 20 percent, more particularly about 7 percent or greater, and more particularly still about 7 percent or greater, such as from about 7 to 20 percent. Thus, the consistency of the wet web upon exiting the air press may be about 25 percent or greater, about 26 percent or greater, about 27 percent or greater, about 28 percent or greater, about 29 percent or greater, and is desirably about 30 percent or greater, particularly about 31 percent or greater, more particularly about 32 percent or greater, such as from about 32 to about 42 percent, more particularly about 33 percent or greater, even more particularly about 34 percent or greater, such as from about 34 to about 42 percent, and still more particularly about 35 percent or greater.

The air press is able to achieve these consistency levels while the machine is operating at industrially useful speeds. As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values. Optional steam showers or the like may be employed before the air press to increase the post air press consistency and/or to modify the cross-machine direction moisture profile of the web. Furthermore, higher consistencies may be achieved when machine speeds are relatively low and the dwell time in the air press in higher.

The pressure differential across the wet web provided by the air press may be about 25 inches of mercury or greater, such as from about 25 to about 120 inches of mercury, particularly about 35 inches of mercury or greater, such as from about 35 to about 60 inches of mercury, and more particularly from about 40 to about 50 inches of mercury. This may be achieved in part by an air plenum of the air press maintaining a fluid pressure on one side of the wet web of greater than 0 to about 60 pounds per square inch gauge (psig), particularly greater than 0 to about 30 psig, more particularly about 5 psig or greater, such as about 5 to about 30 psig, and more particularly still from about 5 to about psig. The collection device of the air press desirably functions as a vacuum box operating at 0 to about 29 inches of mercury vacuum, particularly 0 to about 25 inches of mercury vacuum, particularly greater than 0 to about 25 inches of mercury vacuum, and more particularly from about 10 to about 20 inches of mercury vacuum, such as about 15 inches of mercury vacuum. Both pressure levels within both the air plenum and the collection device are desirably monitored and controlled to predetermined levels.

The collection device desirably but not necessarily forms an integral seal with the air plenum and draws a vacuum to facilitate its function as a collection device for air and liquid. The terms "integral seal" and "integrally sealed" are used herein to refer to: the relationship between the air plenum and the wet web where the air plenum is operatively associated and in indirect contact with the web such that about 70 percent or greater of the air fed to the air plenum flows through the web when the air plenum is operated at a pressure differential across the web of about 30 inches of mercury or greater; and the relationship between the air plenum and the collection device where the air plenum is operatively associated and in indirect contact with the web and the collection device such that about 70 percent or greater of the air fed to the air plenum flows through the web into the collection device when the air plenum and collection device are operated at a pressure differential across the web of about 30 inches of mercury or greater.

Significantly, the pressurized fluid used in the air press is sealed from ambient air to create a substantial air flow through the web, which results in the tremendous dewatering capability of the air press. The flow of pressurized fluid through the air press is suitably from about 5 to about 500 standard cubic feet per minute (SCFM) per square inch of open area, particularly about 10 SCFM per square inch of open area or greater, such as from about 10 to about 200 SCFM per square inch of open area, and more particularly about 40 SCFM per square inch of open area or greater, such as from about 40 to about 120 SCFM per square inch of open area. Desirably, 70 percent or greater, particularly 80 percent or greater, and more particularly 90 percent or greater, of the pressurized fluid supplied to the air plenum is drawn through the wet web into the vacuum box. For purposes of the present invention, the term "standard cubic feet per minute" means cubic feet per minute measured at 14.7 pounds per square inch absolute and 60 degrees Fahrenheit (° F.).

The terms "air" and "pressurized fluid" are used interchangeably herein to refer to any gaseous substance used in the air press to dewater the web. The gaseous substance suitably comprises air, steam or the like. Desirably, the pressurized fluid comprises air at ambient temperature, or air heated only by the process of pressurization to a temperature of about 300° F or less, more particularly about 150° F or less.

The air press is useful in a variety of machine configurations to dewater wet webs, including paper, tissue, corrugate, liner board, newsprint, or the like. In particular, the air press can be employed on a tissue machine to mold the wet web onto a three-dimensional fabric and thereby increase the bulk of the web. The air press can be used in a variety of positions on the machine, particularly where the web is sandwiched between two fabrics, and where the web is transferred onto a three-dimensional fabric. Because the pressure differential generated by the air press is significantly greater than has been possible using conventional vacuum boxes, suction boxes, blow boxes, and the like, tissue webs with relatively high bulks can be created in a molding stage operation utilizing the air press. Various wet-pressed machine configurations that lend themselves to dewatering using the air press are disclosed in U.S. Patent Application Serial No. unknown filed on the same day as the present application by M. Hermans et al. and titled "Method For Making Tissue Sheets On A Modified Conventional Wet-Pressed Machine"; U.S. Patent Application Serial No. unknown filed on the same day as the present application by M. Hermans et al. and titled "Method For Making Low-Density Tissue With Reduced Energy Input"; U.S. Patent Application Serial No. unknown filed on the same day as the present application by F. Druecke al. titled "Method Of Producing Low Density Resilient Webs"; and U.S. Patent Application Serial No. unknown filed on the same day as the present application by S. Chen et al. and titled "Low Density Resilient Webs And Methods Of Making Such Webs"; which are incorporated herein by reference.

In another aspect of the invention, a method for making creped throughdried tissue requires a reduced amount of total energy than conventional creped throughdried processes. The present method utilizes the air press to noncompressively dewater the web, and more particularly nonthermally dewater the web, prior to drying to final dryness using throughdryers. In particular embodiments, the consistency of the web is higher prior to the first throughdryer than is presently feasible with high speed operation of conventional vacuum dewatering devices. Consequently, a throughdryer or throughdryers do not have to remove as much water from the web. The tissue manufacturer is thus free to utilize smaller and more efficient throughdryers, increase the machine speed, reduce the energy input and temperature of the throughdryers, or some combination of these options. In the event the throughdryers are operated at reduced temperatures, there may be additional benefits such as longer useful lives of the fabrics used in the manufacturing process.

Hence, the invention also relates to a method for making a creped throughdried web, comprising: (a) depositing an aqueous suspension of papermaking fibers onto an endless forming fabric to form a wet web; (b) dewatering the wet web to a consistency of about 30 percent or greater using a noncompressive dewatering device that is adapted to cause a pressurized fluid at about 5 pounds per square inch gauge or greater to flow substantially through the web due to an integral seal formed with the wet web; (c) transferring the wet web to a throughdrying fabric; (d) throughdrying the noncompressively dewatered web; (e) transferring the throughdried web onto the surface of a drying cylinder; and (f) removing the throughdried web from the drying cylinder with a creping blade.

In another embodiment, a method for making a creped throughdried web, comprises: (a) depositing an aqueous suspension of papermaking fibers onto an endless forming fabric to form a wet web; (b) sandwiching.the wet web between a pair of fabrics; (c) passing the sandwiched wet web structure between an air plenum and a collection device, the air plenum and collection device being operatively associated and adapted to create a pressure differential across the wet web of about 30 inches of mercury or greater and a stream of pressurized fluid through the wet web of about 10 standard cubic feet per minute per square inch or greater; (d) dewatering the wet web using the stream of pressurized fluid to a consistency of about 30 percent or greater; (e) transferring the wet web to a throughdrying fabric; (f) throughdrying the noncompressively dewatered web; (g) transferring the throughdried web onto the surface of a drying cylinder; and (h) removing the throughdried web from the drying cylinder with a creping blade.

The forming process and tackle can be conventional as is well known in the papermaking industry. Such formation processes include Fourdrinier, roof formers (such as suction breast roll), gap formers (such as twin wire formers, crescent formers), or the like. Forming wires or fabrics can also be conventional, with the finer weaves with greater fiber support being preferred to produce a more smooth sheet or web. Headboxes used to deposit the fibers onto the forming fabric can be layered or nonlayered.

The methods disclosed herein can be applied to any tissue web, which includes webs for making facial tissue, bath tissue, paper towels, wipes, napkins, or the like. Such tissue webs can be single-ply products or multi-ply products, such as two-ply, three-ply, four-ply or greater. One-ply products are advantageous because of their lower cost of manufacture, while multi-ply products are preferred by many consumers. For multi-ply products it is not necessary that all plies of the product be the same, provided at least one ply is in accordance with this invention. The webs can be layered or unlayered (blended), and the fibers making up the web can be any fibers suitable for papermaking.

Suitable basis weights for these tissue webs can be from about 5 to about 70 grams per square meter (gsm), preferably from about 10 to about 40 gsm, and more preferably from about 20 to about 30 gsm. For a single-ply bath tissue, a basis weight of about 25 gsm is preferred. For a two-ply tissue, a basis weight of about 20 gsm per ply is preferred. For a three-ply tissue, a basis weight of about 15 gsm per ply is preferred. In general, higher basis weight webs will require lower air flow to maintain the same operating pressure in the air plenum. The width of the slots of the air press are desirably adjusted to match the system to the available air capacity, with wider slots used for heavier basis weight webs.

The drying process can be any noncompressive drying method which tends to preserve the bulk or thickness of the wet web including, without limitation, throughdrying, infrared irradiation, microwave drying, or the like. Because of its commercial availability and practicality, throughdrying is a well-known and preferred means for noncompressively drying the web. Suitable throughdrying fabrics include, without limitation, Asten 920A and 937A, and Velostar P800 and 103A. The throughdrying fabrics may also include those disclosed in U.S. Pat. No. 5,429,686 issued Jul. 4, 1995, to Chiu et al. The web is preferably dried to final dryness without creping, since creping tends to lower the web strength and bulk.

While the mechanics are not completely understood, it is clear that the transfer fabric and throughdrying fabric can make separate and independent contributions to final sheet properties. For example, sheet surface smoothness as determined by a sensory panel can be manipulated over a broad range by changing transfer fabrics with the same throughdrying fabric. Webs produced by the present method and apparatus tend to be very two-sided unless calendered. Uncalendered webs may, however, be plied together with smooth/rough sides out as required by specific product forms.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE INVENTION

Figure 1:
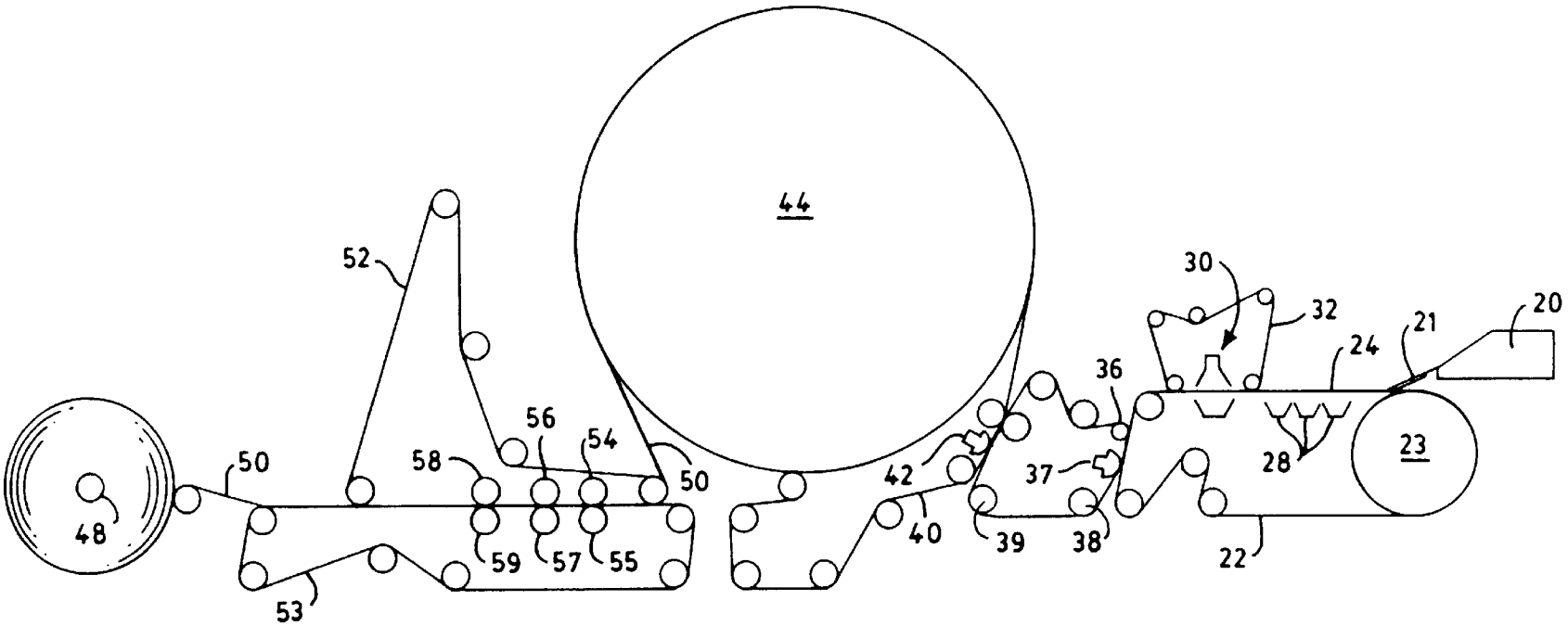
FIG. 1 representatively shows a schematic process flow diagram illustrating a method and apparatus according to the present invention for making uncreped throughdried sheets.

The invention will now be described in greater detail with reference to the Figures.

Similar elements in different Figures have been given the same reference numeral for purposes of consistency and simplicity. In all of the embodiments, illustrated, conventional papermaking apparatus and operations can be used with respect to the headbox, forming fabrics, web transfers, drying and creping, all of which will be readily understood by those skilled in the papermaking art. Nevertheless, various conventional components are illustrated for purposes of providing the context in which the various embodiments of the invention can be used.

One embodiment of a method and apparatus for manufacturing a tissue is representatively shown in FIG. 1. For simplicity, the various tensioning rolls schematically used to define the several fabric runs are shown but not numbered. A papermaking headbox 20 injects or deposits an aqueous suspension of papermaking fibers 21 onto an endless forming fabric 22 traveling about a forming roll 23. The forming fabric 22 allows partial dewatering of the newly-formed wet web 24 to a consistency of about 10 percent.

After formation, the forming fabric 22 carries the wet web 24 to one or more vacuum or suction boxes 28, which may be employed to provide additional dewatering of the wet web 24 while it is supported on the forming fabric 22. In particular, a plurality of vacuum boxes 28 may be used to dewater the web 24 to a consistency of from about 20 to about 30 percent. The Fourdrinier former illustrated is particularly useful for making the heavier basis weight sheets useful as wipers and towels, although other forming devices such as twin wire formers, crescent formers or the like can be used instead. Hydroneedling, for example as disclosed in U.S. Pat. No. 5,137,600 issued Aug. 11, 1992 to Barnes et al., can optionally be employed to increase the bulk of the web.

Enhanced dewatering of the wet web 24 is thereafter provided by suitable supplemental noncompressive dewatering means, for example selected from the group consisting of the air press described herein, infra-red drying, microwave drying, sonic drying, throughdrying, superheated or saturated steam dewatering, supercritical fluid dewatering, and displacement dewatering. In the illustrated embodiment, the supplemental noncompressive dewatering means comprises an air press 30, described in greater detail hereinafter. The air press 30 desirably raises the consistency of the wet web 24 to greater than about 30 percent, such that in particular embodiments the wet web has a consistency upon exiting the air press and prior to subsequent transfer of from about 31 to about 36 percent. In particular embodiments, the air press 30 increases the consistency of the wet web 24 by about 5 percent or greater, such as about 10 percent.

Desirably, a support fabric 32 is brought in contact with the wet web 24 in advance of the air press 30. The wet web 24 is sandwiched between the support fabric 32 and the forming fabric 22, and thus supported during the pressure drop created by the air press 30. Fabrics suitable for use as a support fabric 32 include almost any fabric including forming fabrics such as Albany International 94M.

The wet web 24 is then transferred from the forming fabric 22 to a transfer fabric 36 traveling at a slower speed than the forming fabric in order to impart increased stretch into the web. Transfer is preferably carried out with the assistance of a vacuum transfer shoe 37 as described hereinafter with reference to FIGS. 7 and 8. The surface of the transfer fabric 36 is desirably relatively smooth in order to provide smoothness to the wet web 24. The openness of the transfer fabric 36, as measured by its void volume, is desirably relatively low and can be about the same as that of the forming fabric 22 or even lower. The step of rush transfer can be performed with many of the methods known in the art, particularly for example as disclosed in U.S. patent application Ser. No. 08/790,980 filed Jan. 29, 1997 by Lindsay et al. and titled "Method For Improved Rush Transfer To Produce High Bulk Without Macrofolds"; U.S. patent application Ser. No. 08/709,427 filed Sep. 6, 1996 by Lindsay et al. and titled "Process For Producing High-Bulk Tissue Webs Using Nonwoven Substrates"; U.S. Pat. No. 5,667,636 issued Sep. 16, 1997 to S. A. Engel et al.; and U.S. Pat. No. 5,607,551 issued Mar. 4, 1997 to T. E. Farrington, Jr. et al.; which are incorporated herein by reference.

The transfer fabric 36 passes over rolls 38 and 39 before the wet web 24 is transferred to a throughdrying fabric 40 traveling at about the same speed, or a different speed if desired. Transfer is effected by vacuum transfer shoe 42, which can be of the same design as that used for the previous transfer. The web 24 is dried to final dryness as the web is carried over a throughdryer 44.

Prior to being wound onto a reel 48 for subsequent conversion into the final product form, the dried web 50 can be carried through one or more optional fixed gap fabric nips formed between carrier fabrics 52 and 53. The bulk or caliper of the web 50 can be controlled by fabric embossing nips formed between rolls 54 and 55, 56 and 57, and 58 and 59. Suitable carrier fabrics for this purpose are Albany International 84M or 94M and Asten 959 or 937, all of which are relatively smooth fabrics having a fine pattern. Nip gaps between the various roll pairs can be from about 0.001 inch to about 0.02 inch (0.025–0.51 mm). As shown, the carrier fabric section of the machine is designed and operated with a series of fixed gap nips which serve to control the caliper of the web and can replace or compliment off-line calendering. Alternatively, a reel calender can be employed to achieve final caliper or complement off-line calendering.

Figure 17:
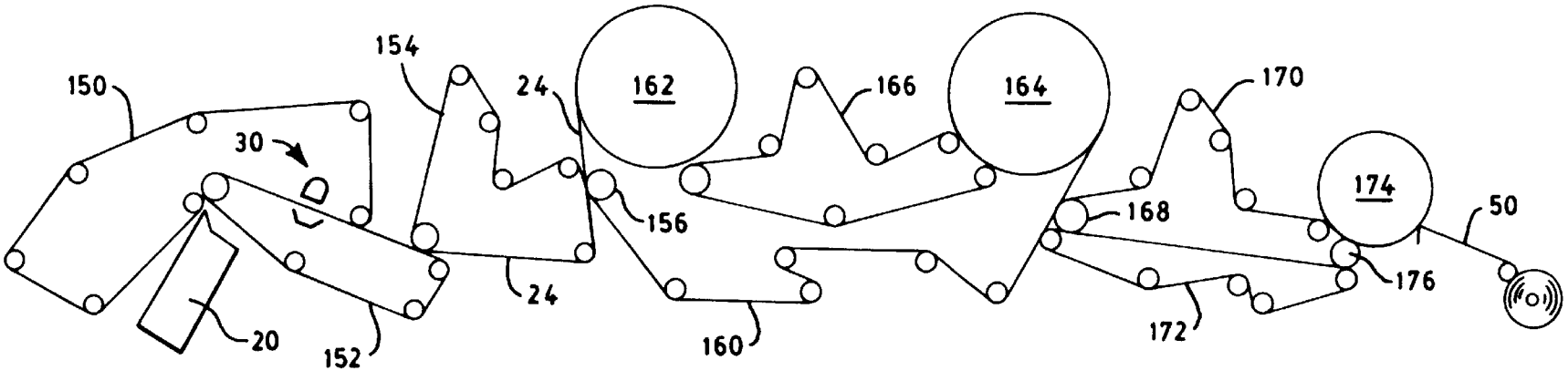
FIG. 17 representatively shows a schematic process flow diagram illustrating a method according to the present invention for making creped throughdried sheets.

A second embodiment of a method and apparatus for manufacturing tissue is representatively shown in FIG. 17. The illustrated method for making creped throughdried sheets includes a papermaking headbox 20 that injects or deposits an aqueous suspension of papermaking fibers between first and second forming fabrics 150 and 152 of a twin wire former to form a wet web 24. Desirably while the web 24 is sandwiched between the forming fabrics 150 and 152, the web is transported through an air press 30 comprising an air plenum and a collection device such as a vacuum box, described in greater detail hereinafter. The web 24 may also be carried over one or more vacuum or suction boxes (not shown) prior to the air press.

The wet web 24 is thereafter transported by the second forming fabric 152 to a transfer fabric 154. A vacuum pickup roll 156 is used to transfer the wet web 24 from the transfer fabric 154 onto a coarse throughdrying fabric 160. The throughdrying fabric is arranged to carry the web over two throughdryers 162 and 164. As illustrated, a separate transfer fabric 166 sandwiches the web against the throughdrying fabric 160 for transport between the two throughdryers. The web 24 is desirably dried to final dryness on the second throughdryer 164.

After the second throughdryer 164, a vacuum roll 168 is used to remove the web from the throughdrying fabric 160, whereupon the web is sandwiched between an impressioning fabric 170 and a transfer fabric 172. The web is then pressed onto the surface of a drying cylinder such as a Yankee dryer 174 with a pressure roll 176. The dried web 50 is desirably removed from the drying cylinder using a creping blade to impart stretch and wound into a roll. Of course, the number and arrangement of throughdryers and fabrics may be varied from that shown in FIG. 17.

The operation of the throughdryers can be enhanced by noncompressively dewatering the web 24 to relatively high consistencies prior to the first throughdryer 162.

In particular, the air press 30 desirably raises the consistency of the wet web 24 to greater than about 30 percent, such that in particular embodiments the wet web has a consistency upon exiting the air press and prior to throughdryer of from about 31 to about 36 percent. In particular embodiments, the air press 30 increases the consistency of the wet web 24 by about 5 percent or greater, such as about 10 percent.

Figure 2:
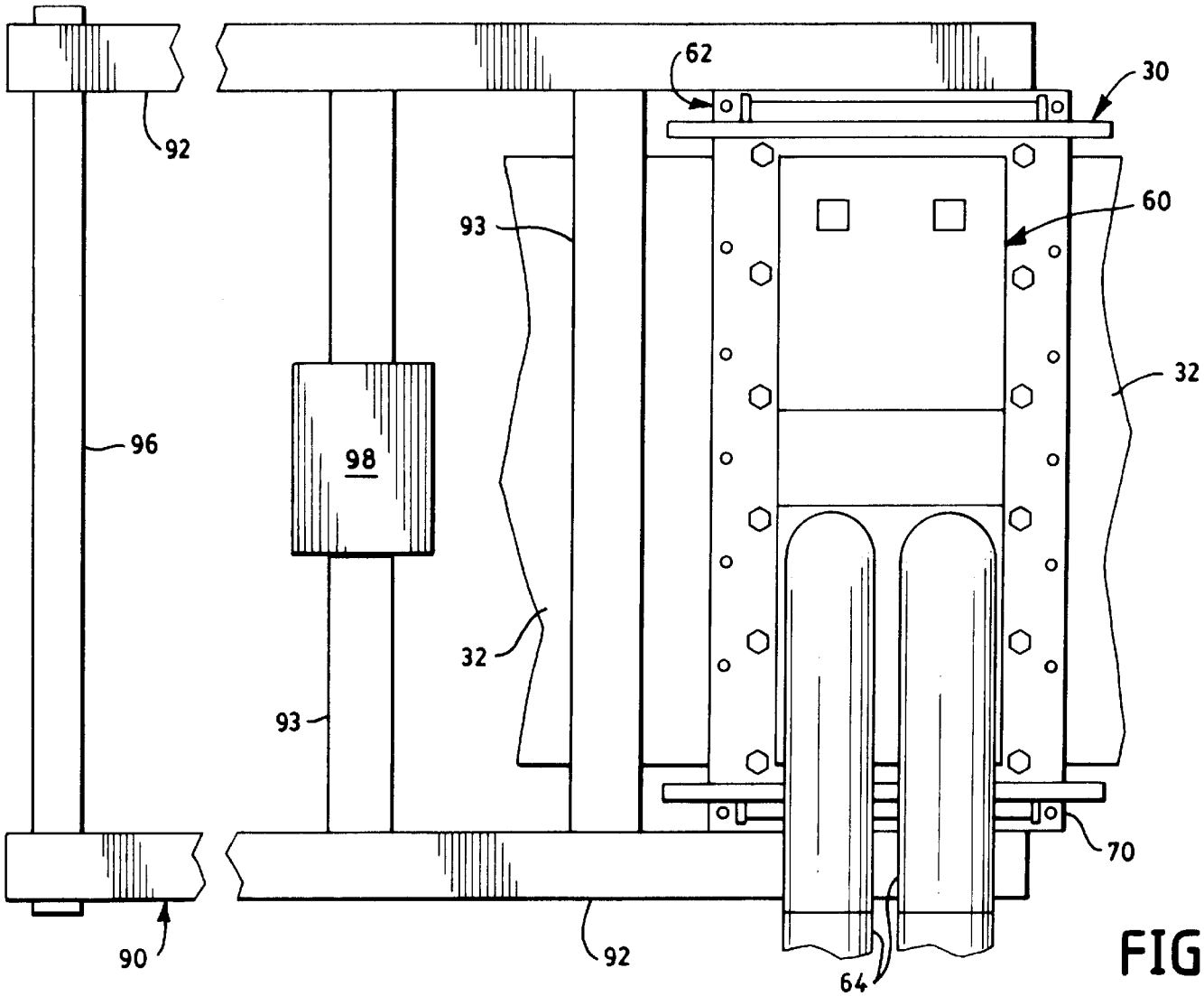
FIG. 2 representatively shows an enlarged top plan view of an air press from the process flow diagram of FIG. 1.
Figure 3:
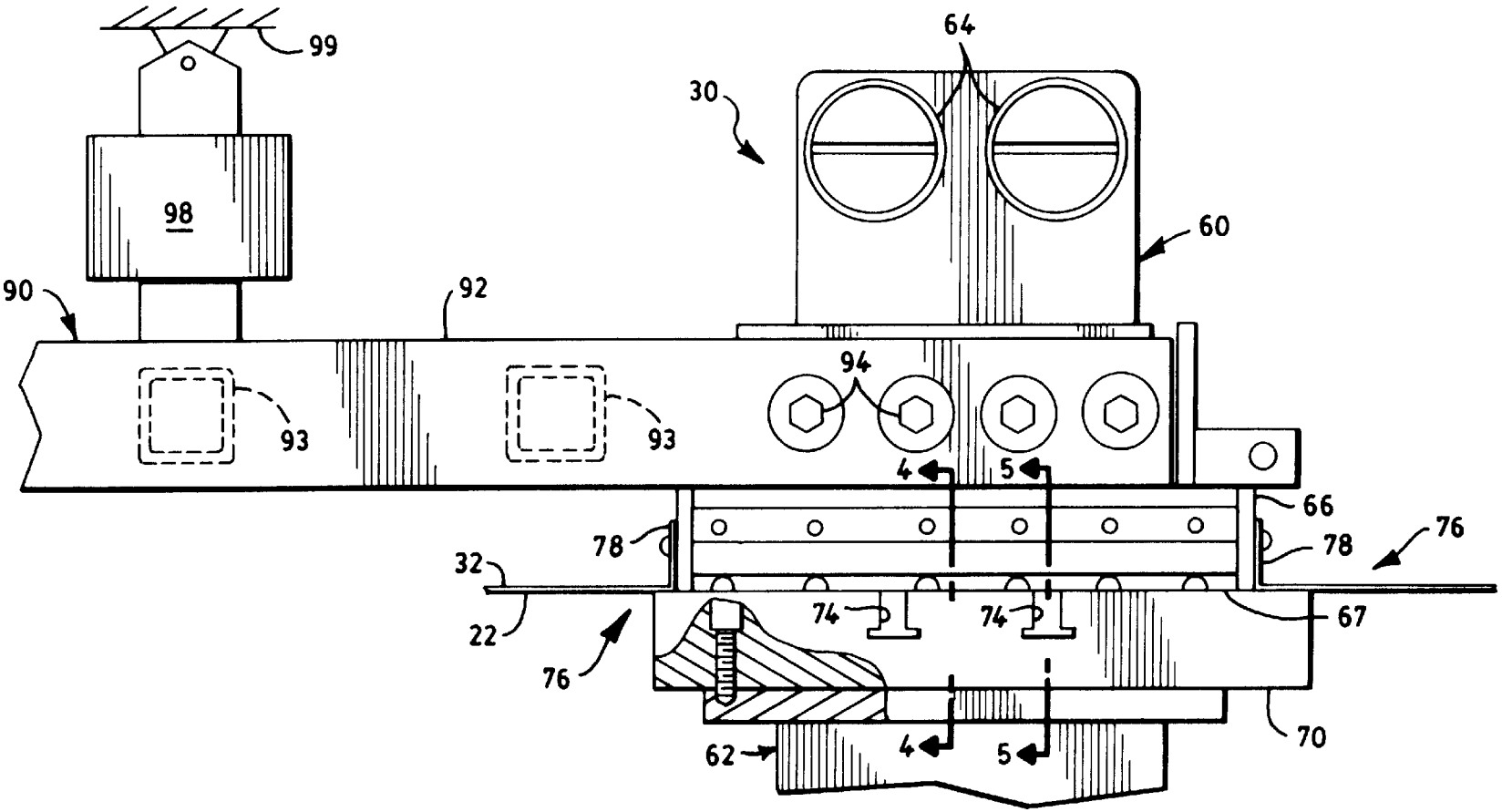
FIG. 3 representatively shows a side view of the air press shown in FIG. 2, with portions broken away and shown in section for purposes of illustration.

The air press 30 is shown in greater detail by the top view of FIG. 2 and the side view of FIG. 3, the latter having portions broken away for purposes of illustration. The air press 30 generally comprises an upper air plenum 60 in combination with a lower collection device in the form of a vacuum or suction box 62. The terms "upper" and "lower" are used herein to facilitate reference to and understanding of the drawings and are not meant to restrict the manner in which the components are oriented. The sandwich of the wet tissue web 24 between the forming fabric 22 and the support fabric 32 (or between forming fabrics 150 and 152) passes between the air plenum 60 and the vacuum box 62.

The illustrated air plenum 60 is adapted to receive a supply of pressurized fluid through air manifolds 64 operatively connected to a pressurized fluid source such as a compressor or blower (not shown). The air plenum 60 is fitted with a plenum cover 66 which has a bottom surface 67 that resides during use in close proximity to the vacuum box 62 and in close proximity to or contact with the support fabric 32 (FIG. 3). The plenum cover 66 is formed with slots 68 (FIG. 5) extending perpendicular to the machine direction across substantially the entire width of the wet web 24 but desirably slightly less than the width of the fabrics to permit passage of pressurized fluid from the air plenum 60 through the fabrics and the wet web.

The vacuum box 62 is operatively connected to a vacuum source and fixedly mounted to a support structure (not shown). The vacuum box 62 comprises a cover 70 having a top surface 72 over which the forming fabric 22 travels. The vacuum box cover 70 is formed with a pair of slots 74 (FIGS. 3 and 5) that correspond to the location of the slots 68 in the plenum cover 66. The pressurized fluid dewaters the wet web 24 as the pressurized fluid is drawn from the air plenum 60 into and through the vacuum box 62.

The fluid pressure within the air plenum 60 is desirably maintained at about 5 pounds per square inch (psi) (0.35 bar) or greater, and particularly within the range of from about 5 to about 30 psi (0.35–2.07 bar), such as about 15 psi (1.03 bar). The fluid pressure within the air plenum 60 is desirably monitored and controlled to a predetermined level.

The bottom surface 67 of the plenum cover 66 is desirably gently curved to facilitate web control. The surface 67 is curved toward the vacuum box 62, that is curved about an axis disposed on the vacuum box side of the web 24. The curvature of the bottom surface 67 allows a change in angle of the combination of the supporting fabric 32, the wet web 24, and the forming fabric 22 resulting in a net downward force that seals the vacuum box 62 against the entry of outside air and supports the wet web 24 during the dewatering process. The angle of curvature allows the loading and unloading of the air press 30 as required from time to time, based on process conditions. The change in angle necessary is dependent on the pressure differential between the pressure and vacuum sides and is desirably above 5 degrees, and particularly within the range of 5 to 30 degrees, typically about 7.5 degrees.

The top and bottom surfaces 72 and 67 desirably have differing radii of curvature. In particular, the radius of curvature of the bottom surface 67 is desirably larger than the radius of curvature of the top surface 72 so as to form contact lines between the air plenum 60 and the vacuum box 62 at the leading and trailing edges 76 of the air press 30. With proper attention to the position of the supporting fabric 32 and the forming fabric 22 sandwich and loading and unloading mechanisms, the radii of curvature of these surfaces may be reversed.

The leading and trailing edges 76 of the air press 30 may also be provided with end seals 78 (FIG. 3) that are maintained in very close proximity to or contact with the support fabric 32 at all times. The end seals 78 minimize the escape of pressurized fluid between the air plenum 60 and the vacuum box 62 in the machine direction. Suitable end seals 78 may be formed of low friction materials such as resilient plastic compounds, materials that preferentially wear relative to the fabrics, or the like. The end seals desirably have curved edges to prevent snagging the fabrics.

Figure 4:
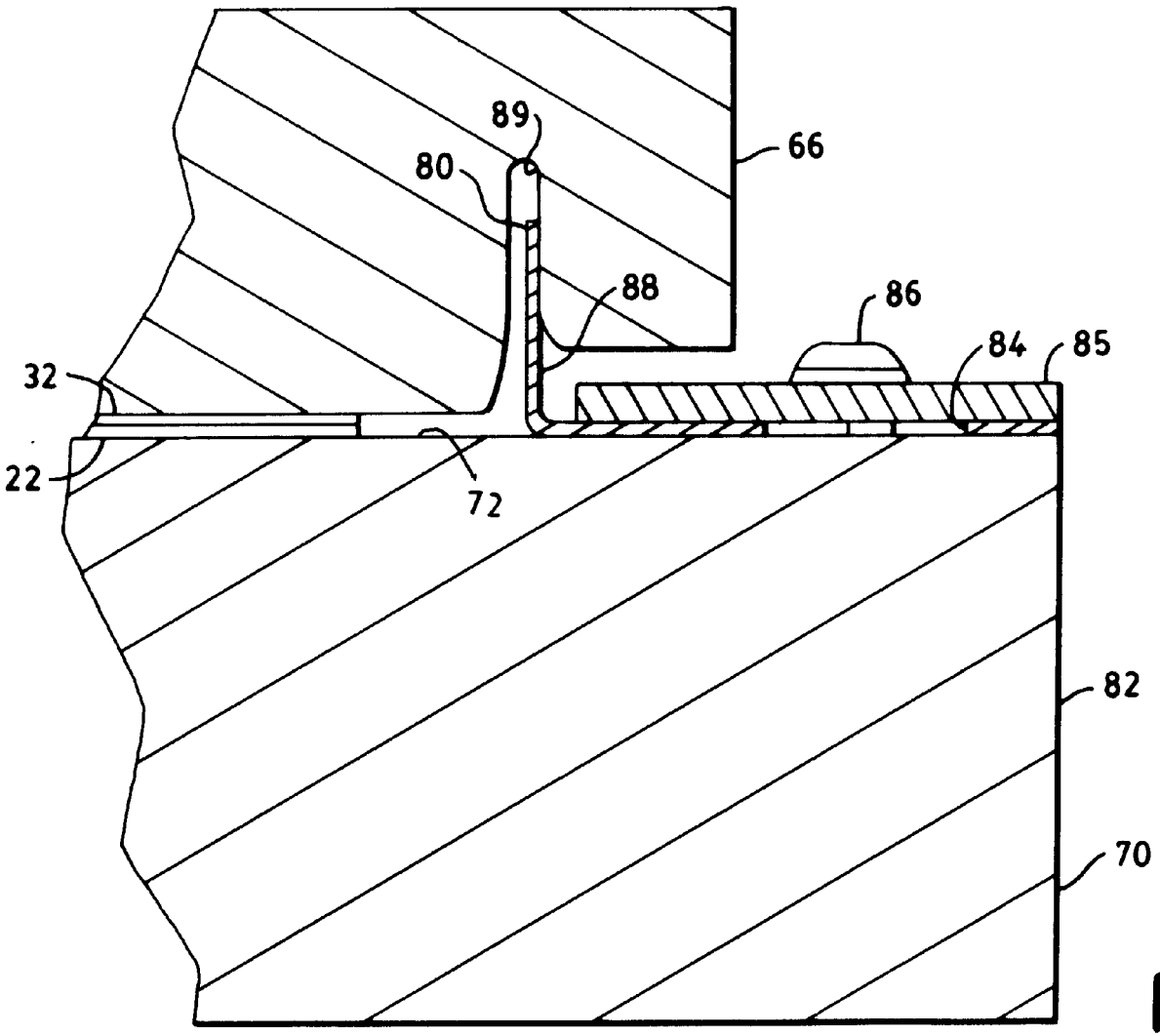
FIG. 4 representatively shows an enlarged section view taken generally from the plane of the line 4—4 in FIG. 3.
Figure 5:
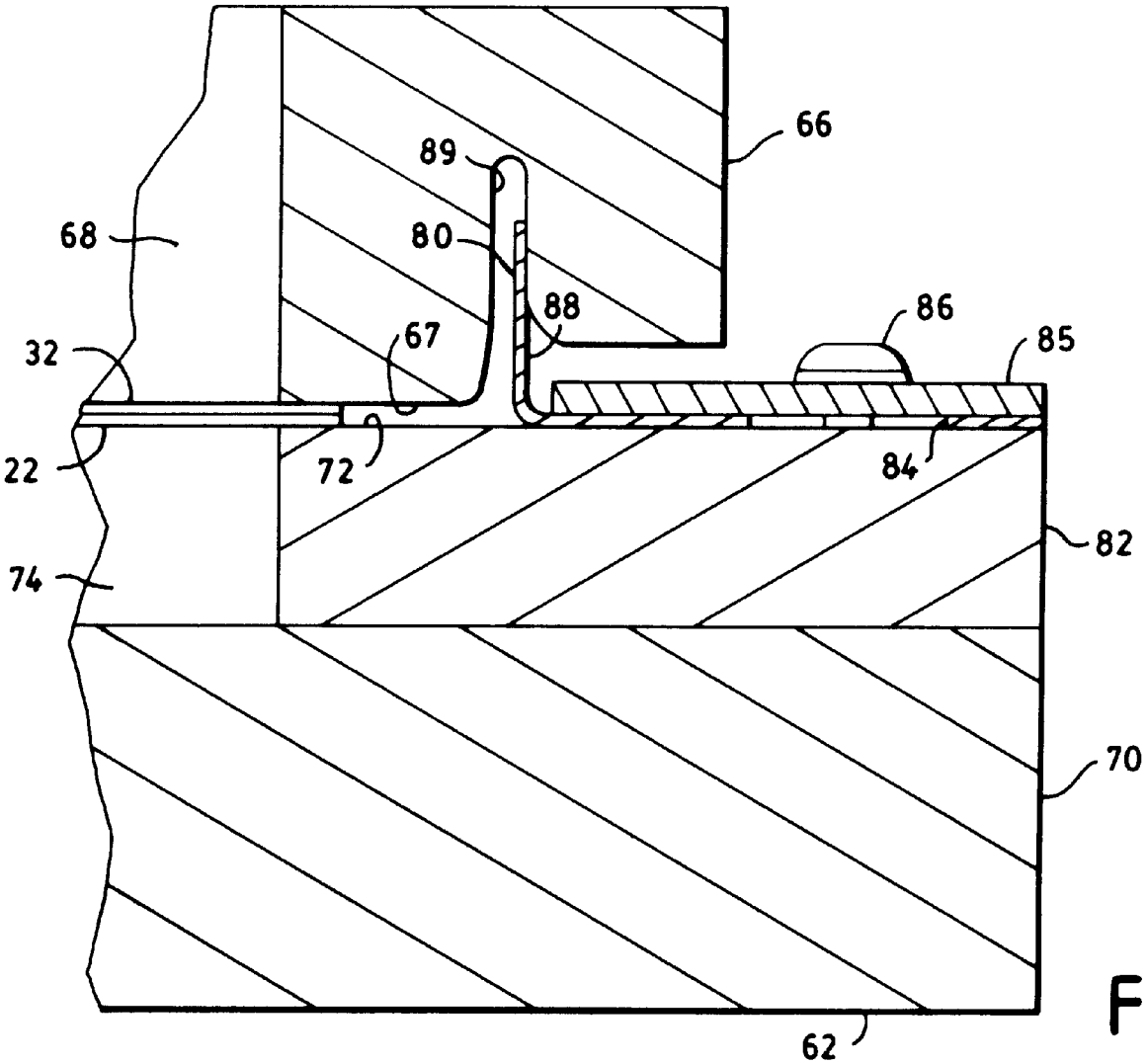
FIG. 5 representatively shows an enlarged section view similar to FIG. 4 but taken generally from the plane of the line 5—5 in FIG. 3.

With additional reference to FIGS. 4 and 5, the air press 30 is desirably provided with side seal members 80 to prevent the loss of pressurized fluid along the side edges 82 of the air press. The side seal members 80 comprise a semi-rigid material that is adapted to deform or flex slightly when exposed to the pressurized fluid of the air plenum 60. The illustrated side seal members 80 define a slot 84 for attachment to the vacuum box cover 70 using a clamping bar 85 and fastener 86 or other suitable means. In cross section, each side seal member 80 is L-shaped with a leg 88 projecting upward from the vacuum box cover 70 into a side seal slot 89 formed in the plenum cover 66. Pressurized fluid from the air plenum 60 causes the legs 88 to bend outward into sealing contact with the outward surface of the side seal slot 89 of the plenum cover 66, as shown in FIGS. 4 and 5. Alternatively, the position of the side seal members 80 could be reversed, such that they are fixedly attached to the plenum cover 66 and make sealing contact with contact surfaces defined by the vacuum box cover 70 (not shown). In any such alternative designs, it is desirable for the side seal member to be urged into engagement with the sealing contact surface by the pressurized fluid.

A position control mechanism 90 maintains the air plenum 60 in close proximity to the vacuum box 62 and in contact with the support fabric 32. The position control mechanism 90 comprises a pair of levers 92 connected by crosspieces 93 and fixedly attached to the air plenum 60 by suitable fasteners 94 (FIG. 3). The ends of the levers 92 opposite the air plenum 60 are rotatably mounted on a shaft 96. The position control mechanism 90 also comprises a counterbalance cylinder 98 operably connecting a fixed structural support 99 and one of the crosspieces 93. The counterbalance cylinder 98 is adapted to extend or retract and thereby cause the levers 92 to rotate about the shaft 96, which causes the air plenum 60 to move closer to or further from the vacuum box 62.

In use, a control system causes the counterbalance cylinder 98 to extend sufficiently for the end seals 78 to contact the support fabric 32 and the side seal members 80 to be positioned within the side seal slots 89. The air press 30 is activated such that pressurized fluid fills the air plenum 60 and the semi-rigid side seal members 80 are forced into sealing engagement with the plenum cover 66. The pressurized fluid also creates an upward force tending to move the air plenum 60 away from the support fabric 32. The control system directs operation of the counterbalance cylinder 98 to offset this upward force based on continuous measurements of the fluid pressure within the air plenum 60 by the pressure monitoring system. The end seals 78 are thereby maintained in very close proximity to or contact with the support fabric 32 at all times. The control system counters random pressure drops or peaks within the air plenum 60 by proportionately decreasing or increasing the force applied by the counterbalance cylinder 98. The air flow within the air press may also be monitored. Consequently, the end seals 78 do not clamp the fabrics 32 and 22, which would otherwise lead to excessive wear of the fabrics.

Figure 6:
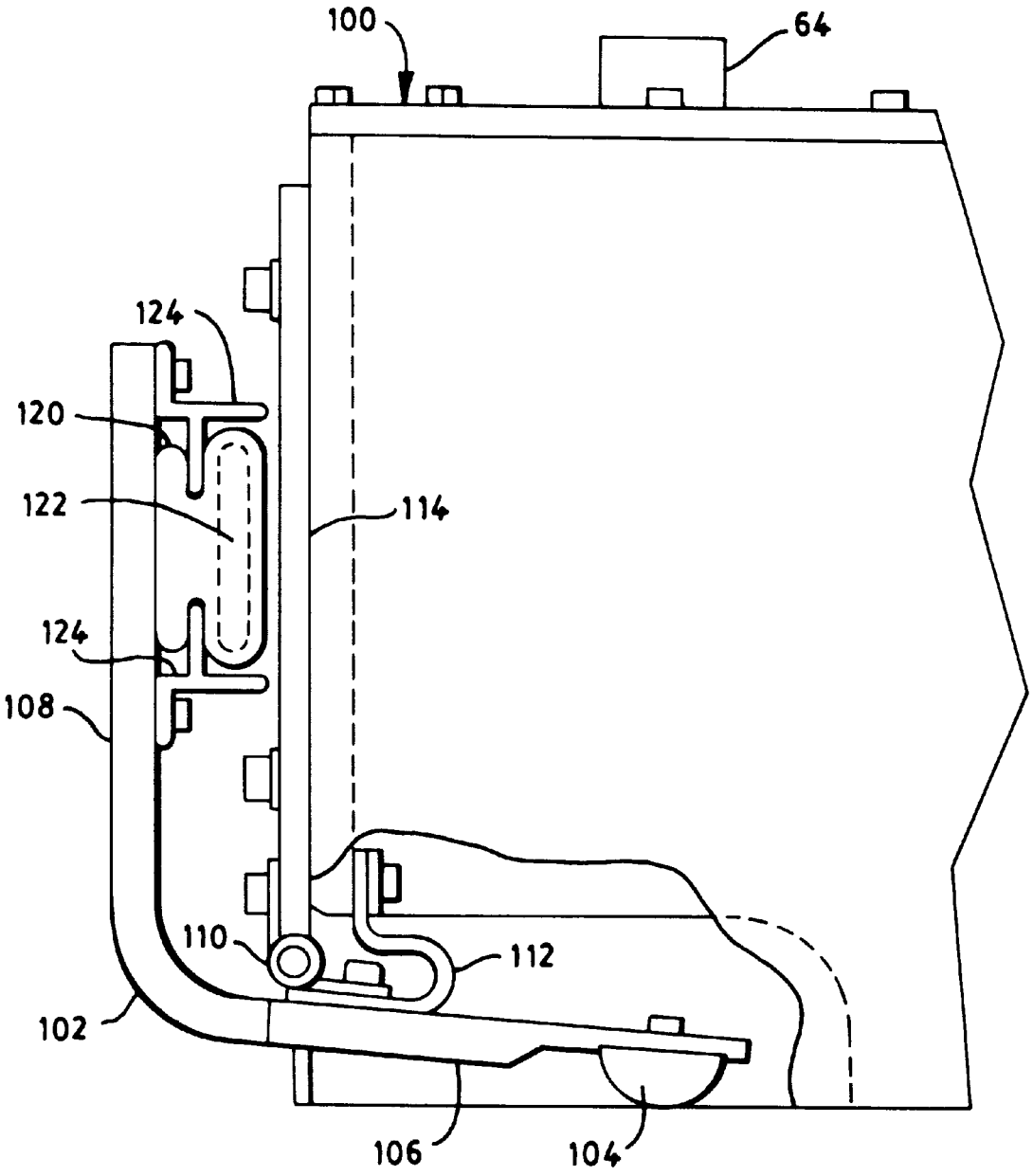
FIG. 6 representatively shows a side view of an alternative sealing system for the air press shown in FIGS. 2 and 3, with portions broken away and shown in section for purposes of illustration.

An alternative sealing system for the air press 30 is representatively shown in FIG. 6. The air plenum 100 is provided with a pivotable arm 102 defining or carrying a sealing bar 104 that is adapted to ride on the support fabric 32 across the width of the wet web 24 to minimize escape of pressurized fluid in the machine direction. While only one arm 102 is illustrated in FIG. 6, it should be understood that a second arm at the opposite end of the air plenum 100 may be employed and constructed in a similar manner. The sides of the air plenum 100 may incorporate side seal members 80 as described in relation to FIGS. 2–5 or be fixedly mounted on the vacuum box 62 to minimize or eliminate side leakage of pressurized fluid.

The pivotable arm 102 desirably comprises a rigid material such as structural steel, graphite composites, or the like. The arm 102 has a first portion 106 disposed at least partially inside the air plenum 100 and a second portion 108 preferably disposed outside the air plenum. The arm 102 is pivotally mounted on the air plenum 100 by a hinge 110. A hinge seal 112 impervious to the pressurized fluid is attached to both the interior surface of a wall 114 of the air plenum 100 and the first portion 106 to prevent escape of the pressurized fluid. The sealing bar 104 is desirably a separate element mounted on the first portion 106 and motivated toward the support fabric 32 (not shown in FIG. 6) by contact of the pressurized fluid on the first portion. Suitable sealing bars 104 may be formed of a low-resistance, low friction coefficient, durable material such as ceramic, heat resistant polymers, or the like.

A counterbalance bladder 120 having an inflatable chamber 122 is mounted on the second portion 108 of the arm 102 with brackets 124 or other suitable means. The chamber 122 is operably connected to a source of pressurized fluid such as air to inflate the chamber. The arm 102 and the bladder 120 are positioned so that the bladder when inflated (not shown) presses against the exterior surface of the wall 114 of the air plenum 100 causing the arm to pivot about the hinge 110. Alternatively, a mechanism using pressurized cylinders (not shown) could be used in place of the counterbalance bladder as a means for pivoting the arm 102.

A control system is operable to inflate or deflate the bladder 120 proportionally in response to the pressure of the fluid within the air plenum 100. For example, as pressure within the air plenum 100 increases, the control system is adapted to increase pressure within or inflation of the counterbalance bladder 120 so that the sealing bar 104 does not clamp down excessively against the support fabric 32.

Figure 7:
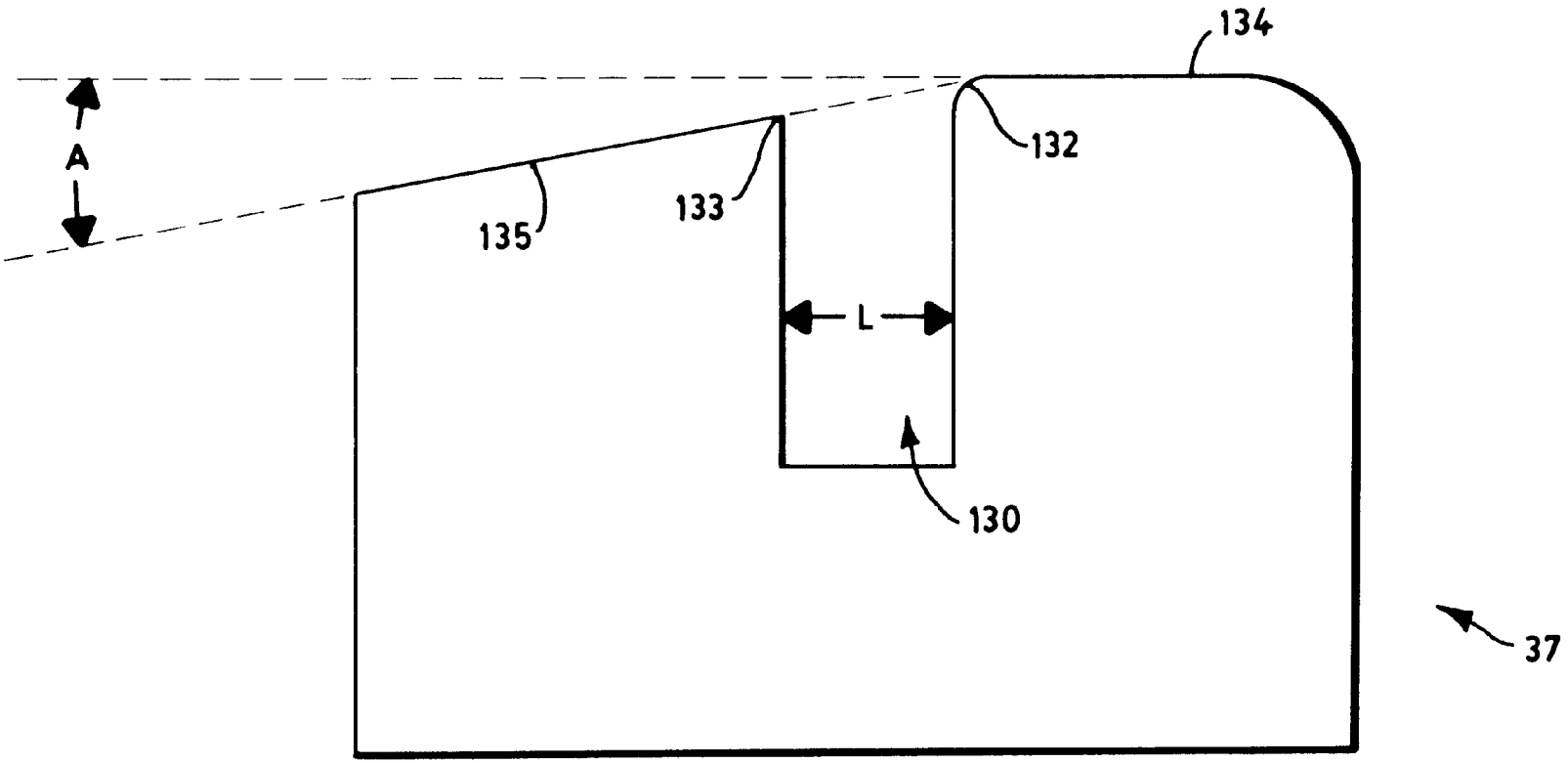
FIG. 7 representatively shows an enlarged side view of a vacuum transfer shoe shown in FIG. 2.
Figure 8:
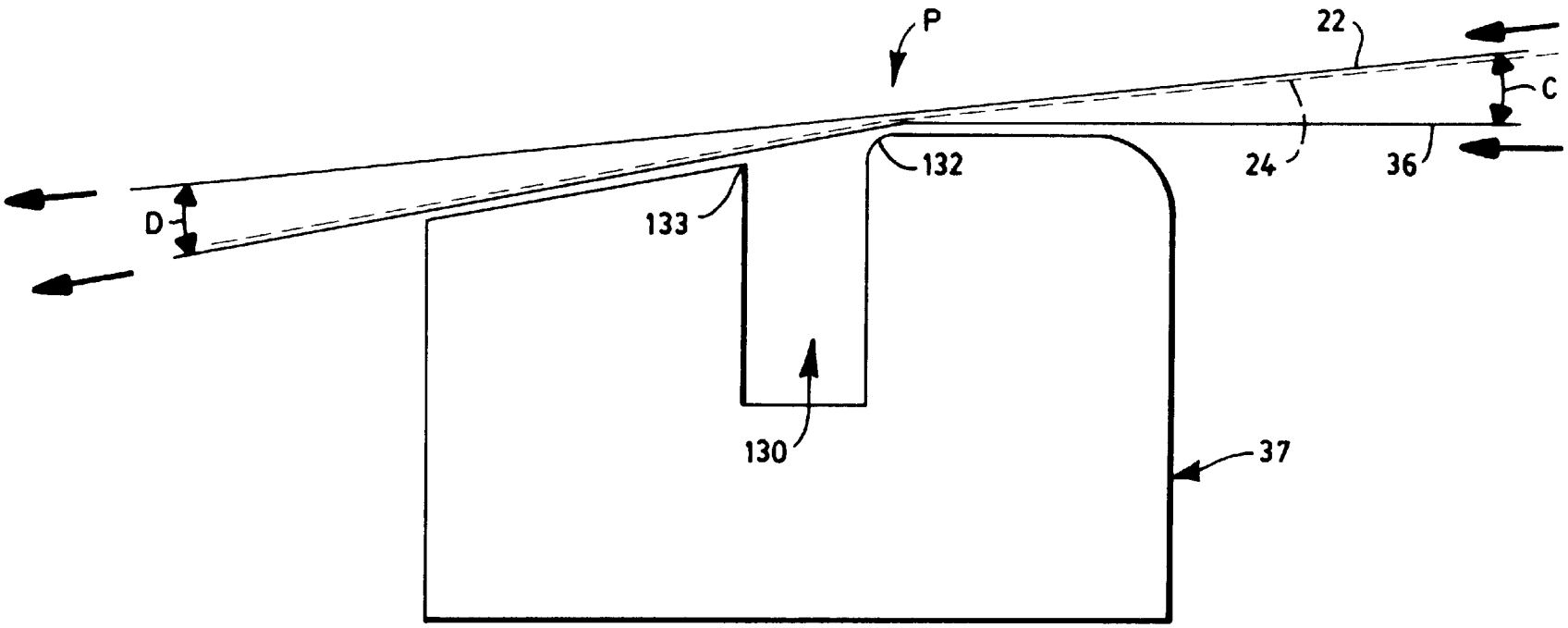
FIG. 8 representatively shows an enlarged side view similar to FIG. 7 but illustrating the simultaneous convergence and divergence of fabrics at a leading edge of a vacuum slot.

The design of the vacuum transfer shoe 37 used in the transfer fabric section of the process (FIG. 1) is more clearly illustrated in FIGS. 7 and 8. The vacuum transfer shoe 37 defines a vacuum slot 130 (FIG. 7) connected to a source of vacuum and having a length of "L" which is suitably from about 0.5 to about 1 inch (12.7–25.4 mm). For producing uncreped throughdried bath tissue, a suitable vacuum slot length is about 1 inch (25.4 mm). The vacuum slot 130 has a leading edge 132 and a trailing edge 133, forming corresponding incoming and outgoing land areas 134 and 135 of the vacuum transfer shoe 37. The trailing edge 133 of the vacuum slot 130 is recessed relative to the leading edge 132, which is caused by the different orientation of the outgoing land area 135 relative to that of the incoming land area 134. The angle "A" between the planes of the incoming land area 134 and the outgoing land area 135 can be about 0.5 degrees or greater, more specifically about 1 degree or greater, and still more specifically about 5 degrees or greater in order to provide sufficient separation of the forming fabric 22 and the transfer fabric 36 as they are converging and diverging.

FIG. 8 further illustrates the wet tissue web 24 traveling in the direction shown by the arrows toward the vacuum transfer shoe 37. Also approaching the vacuum transfer shoe 37 is the transfer fabric 36 traveling at a slower speed. The angle of convergence between the two incoming fabrics is designated as "C". The angle of divergence between the two fabrics is designated as "D". As shown, the two fabrics simultaneously converge and diverge at point "P", which corresponds to the leading edge 132 of the vacuum slot 130. It is not necessary or desirable that the web be in contact with both fabrics over the entire length of the vacuum slot 130 to effect the transfer from the forming fabric 22 to the transfer fabric 36. As is apparent from FIG. 8, neither the forming fabric 22 nor the transfer fabric 36 need to be deflected more than a small amount to carry out the transfer, which can reduce fabric wear. Numerically, the change in direction of either fabric can be less than 5 degrees.

As previously mentioned, the transfer fabric 36 is traveling at a slower speed than the forming fabric 22. If more than one transfer fabric is used, the speed differential between fabrics can be the same or different. Multiple transfer fabrics can provide operational flexibility as well as a wide variety of fabric/speed combinations to influence the properties of the final product.

The level of vacuum used for the differential speed transfers can be from about 3 to about 15 inches of mercury, preferably about 5 inches of mercury. The vacuum shoe (negative pressure) can be supplemented or replaced by the use of positive pressure from the opposite side of the web 24 to blow the web onto the next fabric in addition to or as a replacement for sucking it onto the next fabric with vacuum. Also, a vacuum roll or rolls can be used to replace the vacuum shoe(s).

An alternative embodiment of the air press 200 for dewatering a wet web 24 is shown in FIGS. 10–13. The air press 200 generally comprises an upper air plenum 202 in combination with a lower collection device in the form of a vacuum box 204. The wet web 24 travels in a machine direction 205 between the air plenum and vacuum box while sandwiched between an upper support fabric 206 and a lower support fabric 208. The air plenum and vacuum box are operatively associated with one another so that pressurized fluid supplied to the air plenum travels through the wet web and is removed or evacuated through the vacuum box.

Each continuous fabric 206 and 208 travels over a series of rolls (not shown) to guide, drive and tension the fabric in a manner known in the art. The fabric tension is set to a predetermined amount, suitably from about 10 to about 60 pounds per lineal inch (pli), particularly from about 30 to about 50 pli, and more particularly from about 35 to about 45 pli. Fabrics that may be useful for transporting the wet web 24 through the air press 200 include almost any fluid permeable fabric, for example Albany International 94M, Appleton Mills 2164B, or the like.

Figure 10:
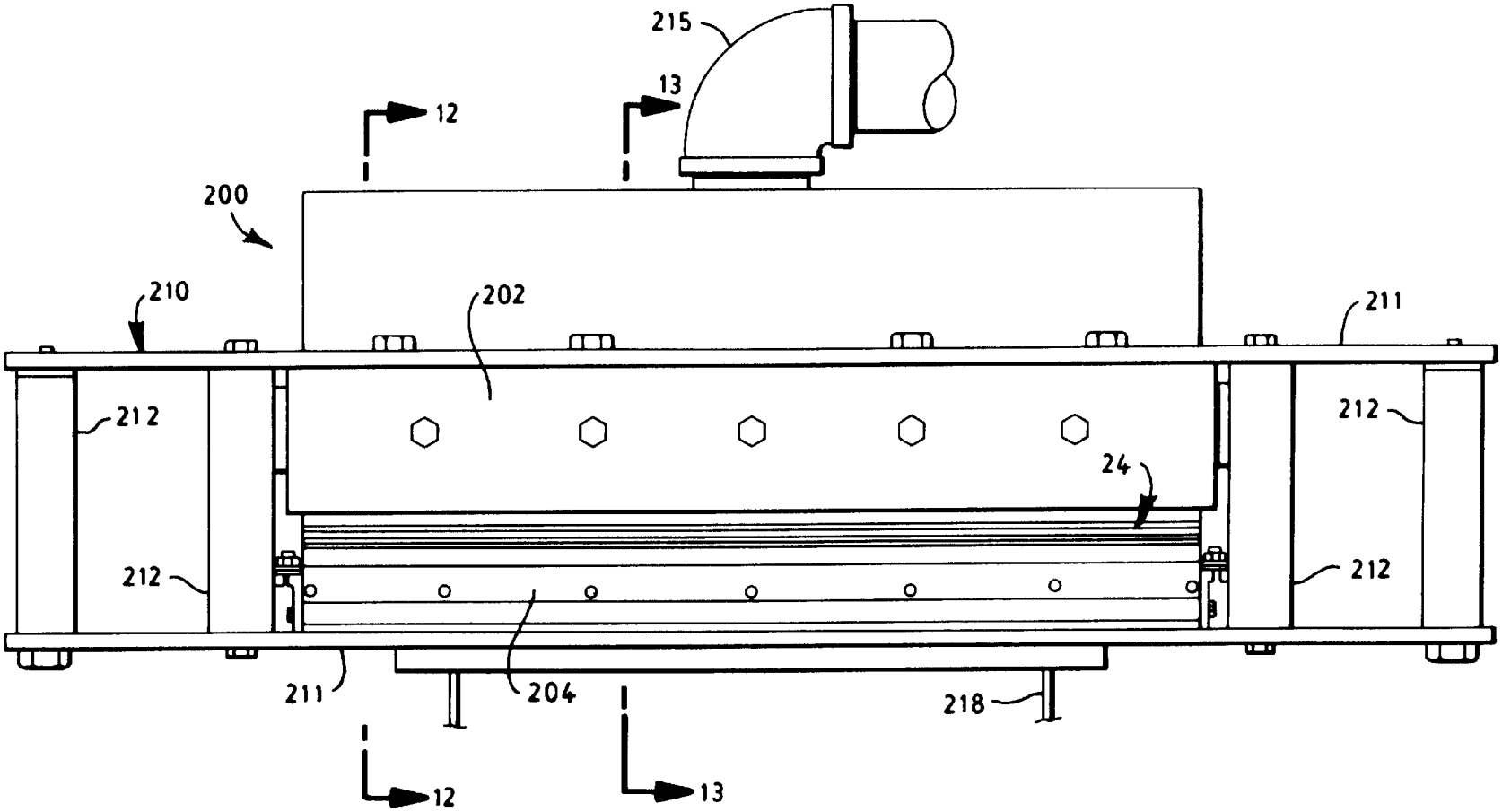
FIG. 10 representatively shows an enlarged end view of an alternative air press according to the present invention, with an air plenum sealing assembly of the air press in a raised position relative to the wet web and vacuum box.
Figure 11:
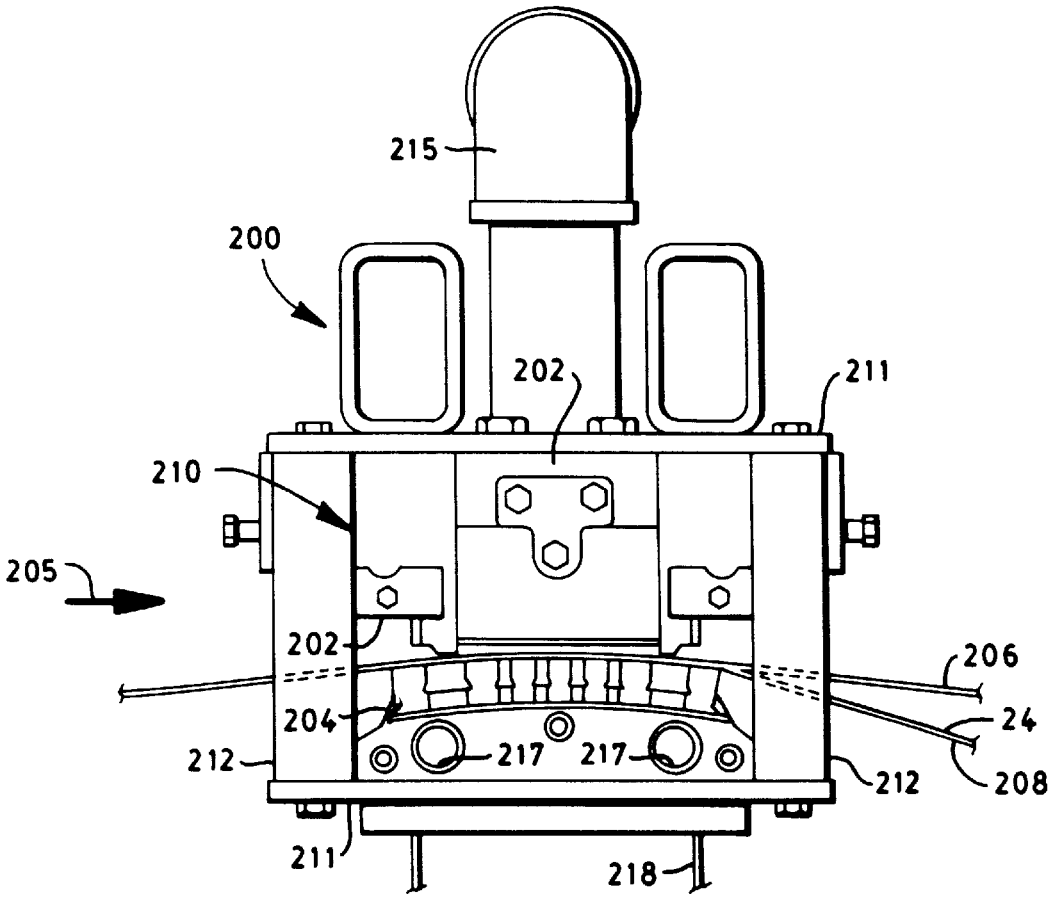
FIG. 11 representatively shows a side view of the air press of FIG. 10.

An end view of the air press 200 spanning the width of the wet web 24 is shown in FIG. 10, and a side view of the air press in the machine direction 205 is shown in FIG. 11. In both Figures, several components of the air plenum 202 are illustrated in a raised or retracted position relative to the wet web 24 and vacuum box 204. In the retracted position, effective sealing of pressurized fluid is not possible. For purposes of the present invention, a "retracted position" of the air press means that the components of the air plenum 202 do not impinge upon the wet web and support fabrics.

Figure 12:
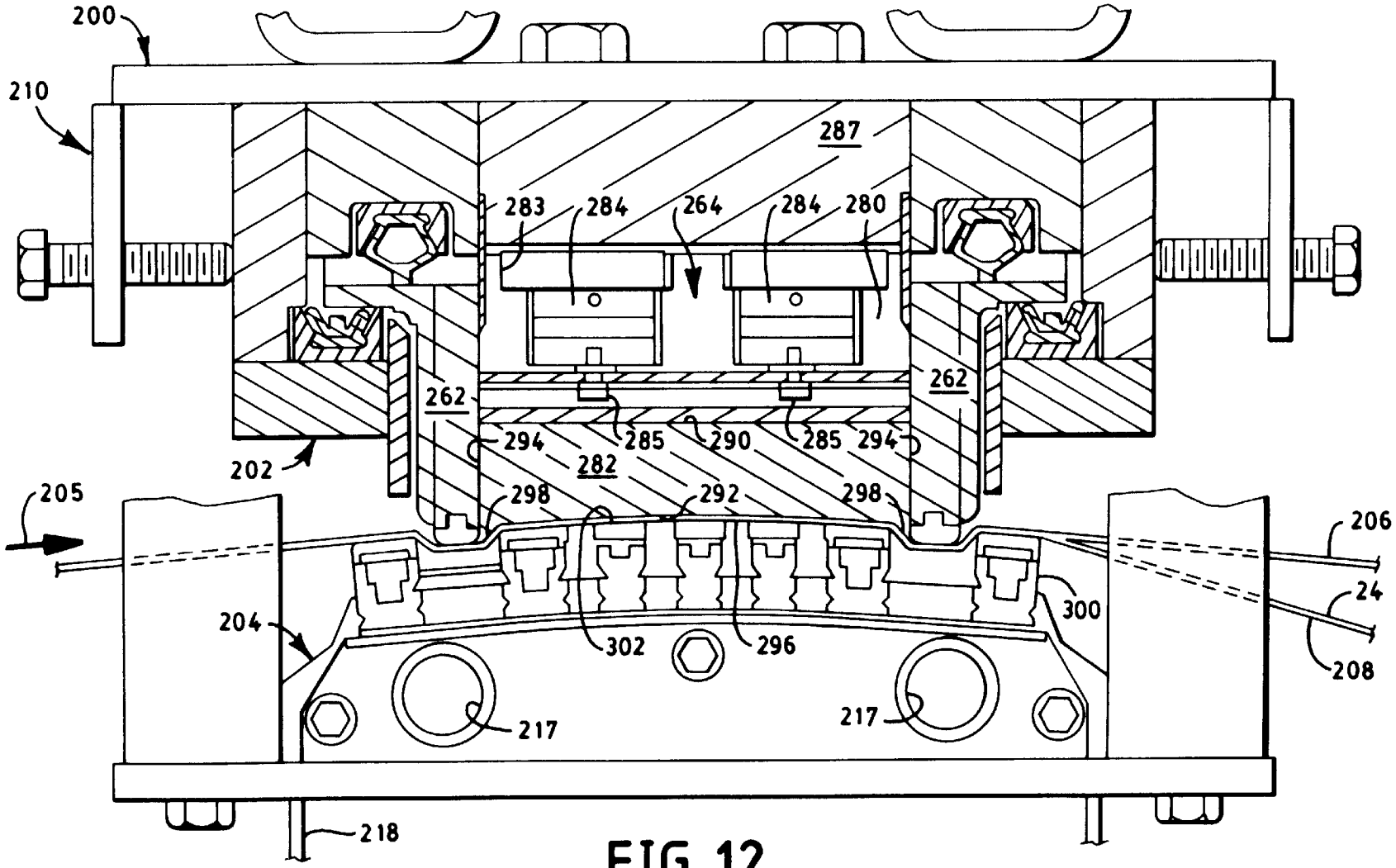
FIG. 12 representatively shows an enlarged section view taken generally from the plane of the line 12—12 in FIG. 10, but with the sealing assembly loaded against the fabrics.
Figure 13:
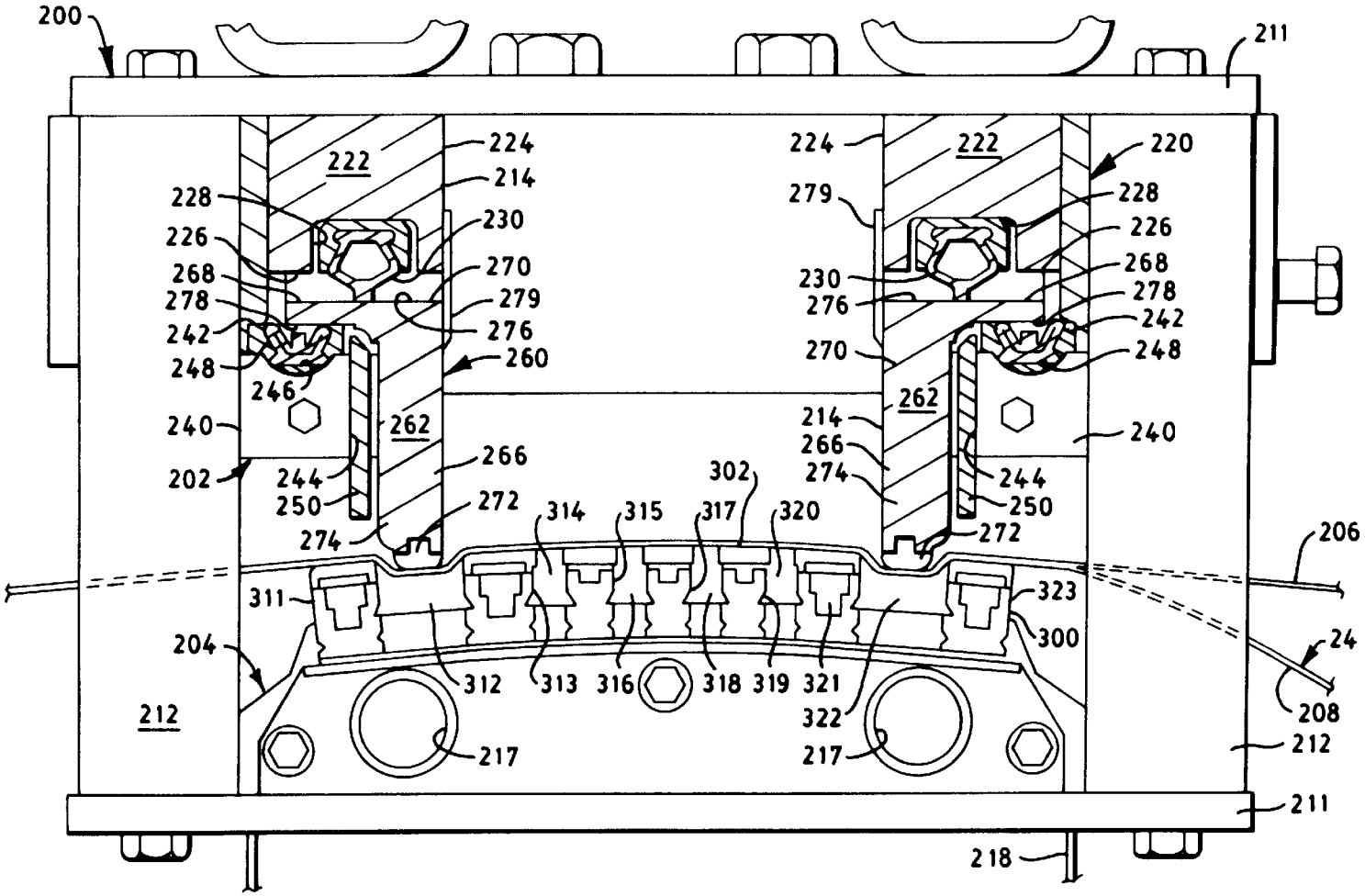
FIG. 13 representatively shows an enlarged section view similar to FIG. 12 but taken generally from the plane of the line 13—13 in FIG. 10.

The illustrated air plenum 202 and vacuum box 204 are mounted within a suitable frame structure 210. The illustrated frame structure comprises upper and lower support plates 211 separated by a plurality of vertically oriented support bars 212. The air plenum 202 defines a chamber 214 (FIG. 13) that is adapted to receive a supply of pressurized fluid through one or more suitable air conduits 215 operatively connected to a pressurized fluid source (not shown). Correspondingly, the vacuum box 204 defines a plurality of vacuum chambers (described hereinafter in relation to FIG. 13) that are desirably operatively connected to low and high vacuum sources (not shown) by suitable fluid conduits 217 and 218, respectively (FIGS. 11, 12 and 13). The water removed from the wet web 24 is thereafter separated from the air streams. Various fasteners for mounting the components of the air press are shown in the Figures but are not labeled.

Enlarged section views of the air press 200 are shown in FIGS. 12 and 13. In these Figures the air press is shown in an operating position wherein components of the air plenum 202 are lowered into an impingement relationship with the wet web 24 and support fabrics 206 and 208. The degree of impingement that has been found to result in proper sealing of the pressurized fluid with minimal contact force and therefore reduced fabric wear is described in greater detail hereinafter.

The air plenum 202 comprises both stationary components 220 that are fixedly mounted to the frame structure 210 and a sealing assembly 260 that is movably mounted relative to the frame structure and the wet web. Alternatively, the entire air plenum could be moveably mounted relative to a frame structure.

With particular reference to FIG. 13, the stationary components 220 of the air plenum include a pair of upper support assemblies 222 that are spaced apart from one another and positioned beneath the upper support plate 211. The upper support assemblies define facing surfaces 224 that are directed toward one another and that partially define therebetween the plenum chamber 214. The upper support assemblies also define bottom surfaces 226 that are directed toward the vacuum box 204. In the illustrated embodiment, each bottom surface 226 defines an elongated recess 228 in which an upper pneumatic loading tube 230 is fixedly mounted. The upper pneumatic loading tubes 230 are suitably centered the cross-machine direction and desirably extend over the full width of the wet web.

The stationary components 220 of the air plenum 202 also include a pair of lower support assemblies 240 that are spaced apart from one another and vertically spaced from the upper support assemblies 222. The lower support assemblies define top surfaces 242 and facing surfaces 244. The top surfaces 242 are directed toward the bottom surfaces 226 of the upper support assemblies 222 and, as illustrated, define elongated recesses 246 in which lower pneumatic loading tubes 248 are fixedly mounted. The lower pneumatic loading tubes 248 are suitably centered in the cross-machine direction and suitably extend over about 50 to 100 percent of the width of the wet web. In the illustrated embodiment, lateral support plates 250 are fixedly attached to the facing surfaces 244 of the lower support assemblies and function to stabilize vertical movement of the sealing assembly 260.

Figure 14:
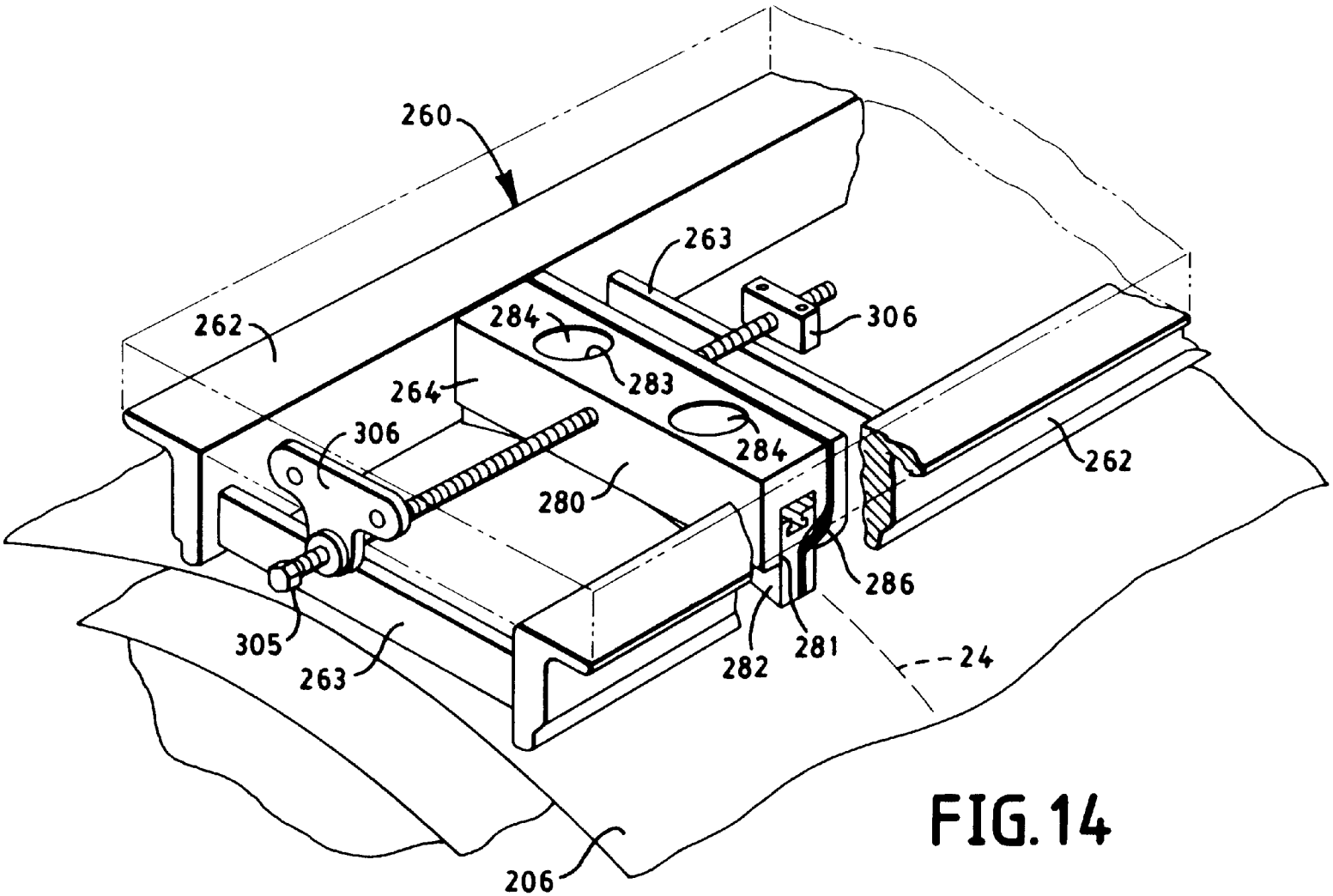
FIG. 14 representatively shows a perspective view of several components of the air plenum sealing assembly positioned against the fabrics, with portions broken away and shown in section for purposes of illustration.

With additional reference to FIG. 14, the sealing assembly 260 comprises a pair of cross-machine direction sealing members referred to as CD sealing members 262 (FIGS. 12–14) that are spaced apart from one another, a plurality of braces 263 (FIG. 14) that connect the CD sealing members, and a pair of machine direction sealing members referred to as MD sealing members 264 (FIGS. 12 and 14). The CD sealing members 262 are vertically moveable relative to the stationary components 220. The optional but desirable braces 263 are fixedly attached to the CD sealing members to provide structural support, and thus move vertically along with the CD sealing members. In the machine direction 205, the MD sealing members 264 are disposed between the upper support assemblies 222 and between the CD sealing members 262. As described in greater detail hereinafter, portions of the MD sealing members are vertically moveable relative to the stationary components 220. In the cross-machine direction, the MD sealing members are positioned near the edges of the wet web 24. In one particular embodiment, the MD sealing members are moveable in the cross-machine direction in order to accommodate a range of possible wet web widths.

The illustrated CD sealing members 262 include a main upright wall section 266, a transverse flange 268 projecting outwardly from a top portion 270 of the wall section, and a sealing blade 272 mounted on an opposite bottom portion 274 of the wall section (FIG. 13). The outwardly-projecting flange 268 thus forms opposite, upper and lower control surfaces 276 and 278 that are substantially perpendicular to the direction of movement of the sealing assembly. The wall section 266 and flange 268 may comprise separate components or a single component as illustrated.

As noted above, the components of the sealing assembly 260 are vertically moveable between the retracted position shown in FIGS. 10 and 11 and the operating position shown in FIGS. 12 and 13. In particular, the wall sections 266 of the CD sealing members 262 are positioned inward of the position control plates 250 and are slideable relative thereto. The amount of vertical movement is determined by the ability of the transverse flanges 268 to move between the bottom surfaces 226 of the upper support assemblies 222 and the top surfaces 242 of the lower support assemblies 240.

The vertical position of the transverse flanges 268 and thus the CD sealing members 262 is controlled by activation of the pneumatic loading tubes 230 and 248. The loading tubes are operatively connected to a pneumatic source and to a control system (not shown) for the air press. Activation of the upper loading tubes 230 creates a downward force on the upper control surfaces 276 of the CD sealing members 262 resulting in a downward movement of the flanges 268 until they contact the top surfaces 242 of the lower support assemblies 240 or are stopped by an upward force caused by the lower loading tubes 248 or the fabric tension. Retraction of the CD sealing members 262 is achieved by activation of the lower loading tubes 248 and deactivation of the upper loading tubes. In this case, the lower loading tubes press upwardly on the lower control surfaces 278 and cause the flanges 268 to move toward the bottom surfaces of the upper support assemblies 222. Of course, the upper and lower loading tubes can be operated at differential pressures to establish movement of the CD sealing members. Alternative means for controlling vertical movement of the CD sealing members can comprise other forms and connections of pneumatic cylinders, hydraulic cylinders, screws, jacks, mechanical linkages, or other suitable means. Suitable loading tubes are available from Seal Master Corporation of Kent, Ohio.

As shown in FIG. 13, a pair of bridge plates 279 span the gap between the upper support assemblies 222 and the CD sealing members 262 to prevent the escape of pressurized fluid. The bridge plates thus define part of the air plenum chamber 214. The bridge plates may be fixedly attached to the facing surfaces 224 of the upper support assemblies and slideable relative to the inner surfaces of the CD sealing members, or vice versa. The bridge plates may be formed of a fluid impermeable, semi-rigid, low-friction material such as LEXAN, sheet metal or the like.

The sealing blades 272 function together with other features of the air press to minimize the escape of pressurized fluid between the air plenum 202 and the wet web 24 in the machine direction. Additionally, the sealing blades are desirably shaped and formed in a manner that reduces the amount of fabric wear. In particular embodiments, the sealing blades are formed of resilient plastic compounds, ceramic, coated metal substrates, or the like.

With particular reference to FIGS. 12 and 14, the MD sealing members 264 are spaced apart from one another and adapted to prevent the loss of pressurized fluid along the side edges of the air press. FIGS. 12 and 14 each show one of the MD sealing members 264, which are positioned in the cross-machine direction near the edge of the wet web 24. As illustrated, each MD sealing member comprises a transverse support member 280, an end deckle strip 282 operatively connected to the transverse support member, and actuators 284 for moving the end deckle strip relative to the transverse support member. The transverse support members 280 are normally positioned near the side edges of the wet web 24 and are generally located between the CD sealing members 262. As illustrated, each transverse support member defines a downwardly directed channel 281 (FIG. 14) in which the an end deckle strip is mounted. Additionally, each transverse support member defines circular apertures 283 in which the actuators 284 are mounted.

The end deckle strips 282 are vertically moveable relative to the transverse support members 280 due to the cylindrical actuators 284. Coupling members 285 (FIG. 12) link the end deckle strips to the output shaft of the cylindrical actuators. The coupling members may comprise an inverted T-shaped bar or bars so that the end deckle strips may slide within the channel 281, such as for replacement.

As shown in FIG. 14, both the transverse support members 280 and the end deckle strips 282 define slots to house a fluid impermeable sealing strip 286, such as O-ring material or the like. The sealing strip helps seal the air chamber 214 of the air press from leaks. The slots in which the sealing strip resides is desirably widened at the interface between the transverse support members 280 and the end deckle strips 282 to accommodate relative movement between those components.

A bridge plate 287 (FIG. 12) is positioned between the MD sealing members 264 and the upper support plate 211 and fixedly mounted to the upper support plate. Lateral portions of the air chamber 214 (FIG. 13) are defined by the bridge plate. Sealing means such as a fluid impervious gasketing material is desirably positioned between the bridge plate and the MD sealing members to permit relative movement therebetween and to prevent the loss of pressurized fluid.

The actuators 284 suitably provide controlled loading and unloading of the end deckle strips 282 against the upper support fabric 206, independent of the vertical position of the CD sealing members 262. The load can be controlled exactly to match the necessary sealing force. The end deckle strips can be retracted when not needed to eliminate all end deckle and fabric wear. Suitable actuators are available from Bimba Corporation. Alternatively, springs (not shown) may be used to hold the end deckle strips against the fabric although the ability to control the position of the end deckle strips may be sacrificed.

With reference to FIG. 12, each end deckle strip 282 has a top surface or edge 290 disposed adjacent to the coupling members 285, an opposite bottom surface or edge 292 that resides during use in contact with the fabric 206, and lateral surfaces or edges 294 that are in close proximity to the CD sealing members 262. The shape of the bottom surface 292 is suitably adapted to match the curvature of the vacuum box 204. Where the CD sealing members 262 impinge upon the fabrics, the bottom surface 292 is desirably shaped to follow the curvature of the fabric impingement. Thus, the bottom surface has a central portion 296 that is laterally surrounded in the machine direction by spaced apart end portions 298. The shape of the central portion 296 generally tracks the shape of the vacuum box while the shape of the end portions 298 generally tracks the deflection of the fabrics caused by the CD sealing members 262. To prevent wear on the projecting end portions 298, the end deckle strips are desirably retracted before the CD sealing members 262 are retracted. The end deckle strips 282 are desirably formed of a gas impermeable material that minimizes fabric wear. Particular materials that may be suitable for the end deckles include polyethylene, nylon, or the like.

The MD sealing members 264 are desirably moveable in the cross-machine direction and are thus desirably slideably positioned against the CD sealing members 262. In the illustrated embodiment, movement of the MD sealing members 264 in the cross-machine direction is controlled by a threaded shaft or bolt 305 that is held in place by brackets 306 (FIG. 14). The threaded shaft 305 passes through a threaded aperture in the transverse support member 280 and rotation of the shaft causes the MD sealing member to move along the shaft. Alternative means for moving the MD sealing members 264 in the cross-machine direction such as pneumatic devices or the like may also be used. In one alternative embodiment, the MD sealing members are fixedly attached to the CD sealing members so that the entire sealing assembly is raised and lowered together (not shown). In another alternative embodiment, the transverse support members 280 are fixedly attached to the CD sealing members and the end deckle strips are adapted to move independently of the CD sealing members (not shown).

The vacuum box 204 comprises a cover 300 having a top surface 302 over which the lower support fabric 208 travels. The vacuum box cover 300 and the sealing assembly 260 are desirably gently curved to facilitate web control, as described previously in relation to other embodiments. The illustrated vacuum box cover is formed, from the leading edge to the trailing edge in the machine direction 205, with a first exterior sealing shoe 311, a first sealing vacuum zone 312, a first interior sealing shoe 313, a series of four high vacuum zones 314, 316, 318 and 320 surrounding three interior shoes 315, 317 and 319, a second interior sealing shoe 321, a second sealing vacuum zone 322, and a second exterior sealing shoe 323 (FIG. 13). Each of these shoes and zones desirably extend in the cross-machine direction across the full width of the web. The shoes each include a top surface desirably formed of a ceramic material to ride against the lower support fabric 208 without causing significant fabric wear. Suitable vacuum box covers and shoes may be formed of plastics, NYLON, coated steels or the like, and are available from JWI Corporation or IBS Corporation.

The four high vacuum zones 314, 316, 318 and 320 are passageways in the cover 300 that are operatively connected to one or more vacuum sources (not shown) that draw a relatively high vacuum level. For example, the high vacuum zones may be operated at a vacuum of 0 to 25 inches of mercury vacuum, and more particularly about 10 to about 25 inches of mercury vacuum. As an alternative to the illustrated passageways, the cover 300 could define a plurality of holes or other shaped openings (not shown) that are connected to a vacuum source to establish a flow of pressurized fluid through the web. In one embodiment, the high vacuum zones comprise slots each measuring 0.375 inch in the machine direction and extending across the full width of the wet web. The dwell time that any given point on the web is exposed to the flow of pressurized fluid, which in the illustrated embodiment is the time over slots 314, 316, 318 and 320, is suitably about 10 milliseconds or less, particularly about 7.5 milliseconds or less, more particularly 5 milliseconds or less, such as about 3 milliseconds or less or even about 1 millisecond or less. The number and width of the high pressure vacuum slots and the machine speed determine the dwell time. The selected dwell time will depend on the type of fibers contained in the wet web and the desired amount of dewatering.

The first and second sealing vacuum zones 312 and 322 may be employed to minimize the loss of pressurized fluid from the air press. The sealing vacuum zones are passageways in the cover 300 that may be operatively connected to one or more vacuum sources (not shown) that desirably draw a relatively lower vacuum level as compared to the four high vacuum zones. Specifically, the amount of vacuum that is desirable for the sealing vacuum zones is 0 to about 100 inches water column, vacuum.

The air press 200 is desirably constructed so that the CD sealing members 262 are disposed within the sealing vacuum zones 312 and 322. More specifically, the sealing blade 272 of the CD sealing member 262 that is on the leading side of the air press is disposed between, and more particularly centered between, the first exterior sealing shoe 311 and the first interior sealing shoe 313, in the machine direction. The trailing sealing blade 272 of the CD sealing member is similarly disposed between, and more particularly centered between, the second interior sealing shoe 321 and the second exterior sealing shoe 323, in the machine direction. As a result, the sealing assembly 260 can be lowered so that the CD sealing members deflect the normal course of travel of the wet web 24 and fabrics 206 and 208 toward the vacuum box, which is shown in slightly exaggerated scale in FIG. 13 for purposes of illustration.

The sealing vacuum zones 312 and 322 function to minimize the loss of pressurized fluid from the air press 200 across the width of the wet web 24. The vacuum in the sealing vacuum zones 312 and 322 draws pressurized fluid from the air plenum 202 and draws ambient air from outside the air press. Consequently, an air flow is established from outside the air press into the sealing vacuum zones rather than a pressurized fluid leak in the opposite direction. Due to the relative difference in vacuum between the high vacuum zones and the sealing vacuum zones, though, the vast majority of the pressurized fluid from the air plenum is drawn into the high vacuum zones rather than the sealing vacuum zones.

Figure 15:
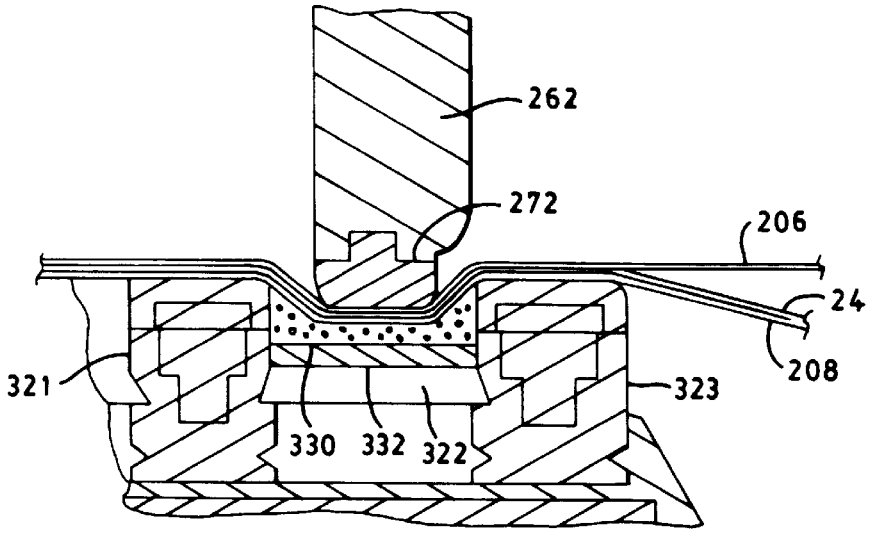
FIG. 15 representatively shows an enlarged section view of an alternative sealing configuration for the air press of FIG. 10.

In an alternative embodiment which is partially illustrated in FIG. 15, no vacuum is drawn in either or both of the sealing vacuum zones 312 and 322. Rather, deformable sealing deckles 330 are disposed in the sealing zones 312 and 322 (only 322 shown) to prevent leakage of pressurized fluid in the machine direction. In this case, the air press is sealed in the machine direction by the sealing blades 272 that impinge upon the fabrics 206 and 208 and the wet web 24 and by the fabrics and the wet web being displaced in close proximity to or contact with the deformable sealing deckles 330. This configuration, where the CD sealing members 262 impinge upon the fabrics and wet web and the CD sealing members are opposed on the other side of the fabrics and the wet web by deformable sealing deckles 330, has been found to produce a particularly effective air plenum seal.

The deformable sealing deckles 330 desirably extend across the full width of the wet web to seal the leading end, the trailing end, or both the leading and the trailing end of the air press 200. The sealing vacuum zone may be disconnected from the vacuum source when the deformable sealing deckle extends across the full web width. Where the trailing end of the air press employs a full width deformable sealing deckle, a vacuum device or blow box may be employed downstream of the air press to cause the web 24 to remain with one of the fabrics as the fabrics are separated.

The deformable sealing deckles 330 desirably either comprise a material that preferentially wears relative to the fabric 208, meaning that when the fabric and the material are in use the material will wear away without causing significant wear to the fabric, or comprise a material that is resilient and that deflects with impingement of the fabric. In either case, the deformable sealing deckles are desirably gas impermeable, and desirably comprise a material with high void volume, such as a closed cell foam or the like. In one particular embodiment, the deformable sealing deckles comprise a closed cell foam measuring 0.25 inch in thickness. Most desirably, the deformable sealing deckles themselves become worn to match the path of the fabrics. The deformable sealing deckles are desirably accompanied by a backing plate 332 for structural support, for example an aluminum bar.

In embodiments where full width sealing deckles are not used, sealing means of some sort are required laterally of the web. Deformable sealing deckles as described above, or other suitable means known in the art, may be used to block the flow of pressurized fluid through the fabrics laterally outward of wet web.

The degree of impingement of the CD sealing members into the upper support fabric 206 uniformly across the width of the wet web has been found to be a significant factor in creating an effective seal across the web. The requisite degree of impingement has been found to be a function of the maximum tension of the upper and lower support fabrics 206 and 208, the pressure differential across the web and in this case between the air plenum chamber 214 and the sealing vacuum zones 312 and 322, and the gap between the CD sealing members 262 and the vacuum box cover 300.

Figure 16:
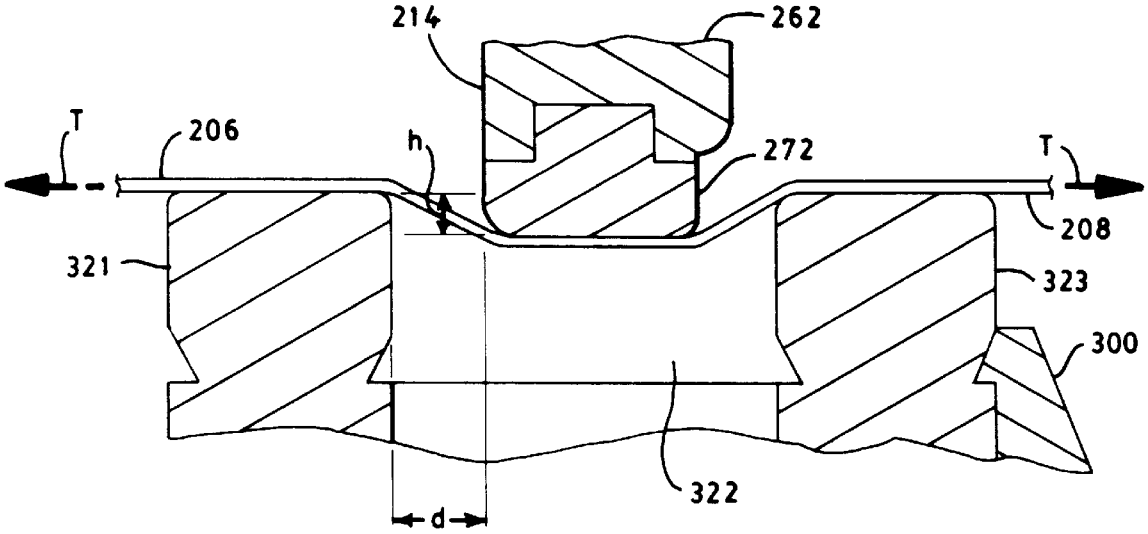
FIG. 16 representatively shows an enlarged schematic diagram of a sealing section of the air press of FIG. 10.

With additional reference to the schematic diagram of the trailing sealing section of the air press shown in FIG. 16, the minimum desirable amount of impingement of the CD sealing member 262 into the upper support fabric 206, h(min), has been found to be represented by the following equation:

$$h(\min) = \frac{T}{W}\left(\cosh\left(\frac{Wd}{T}\right) - 1\right);$$

where:

T is the tension of the fabrics measured in pounds per inch;

W is the pressure differential across the web measured in psi; and d is the gap in the machine direction measured in inches.

FIG. 16 shows the trailing CD sealing member 262 deflecting the upper support fabric 206 by an amount represented by arrow "h". The maximum tension of the upper and lower support fabrics 206 and 208 is represented by arrow "T". Fabric tension can be measured by a model tensometer available from Huyck Corporation or other suitable methods. The gap between the sealing blade 272 of the CD sealing member and the second interior sealing shoe 321 measured in the machine direction and represented by arrow "d". The gap "d" of significance for the determining impingement is the gap on the higher pressure differential side of the sealing blade 272, that is, toward the plenum chamber 214, because the pressure differential on that side has the most effect on the position of the fabrics and web. Desirably, the gap between the sealing blade and the second exterior shoe 323 is approximately the same or less than gap "d". Adjusting the vertical placement of the CD sealing members 262 to the minimum degree of impingement as defined above is a determinative factor in the effectiveness of the CD seal. The loading force applied to the sealing assembly 260 plays a lesser role in determining the effectiveness of the seal, and need only be set to the amount needed to maintain the requisite degree of impingement. Of course, the amount of fabric wear will impact the commercial usefulness of the air press 200. To achieve effective sealing without substantial fabric wear, the degree of impingement is desirably equal to or only slightly greater than the minimum degree of impingement as defined above. To minimize the variability of fabric wear across the width of the fabrics, the force applied to the fabric is desirably kept constant over the cross machine direction. This can be accomplished with either controlled and uniform loading of the CD sealing members or controlled position of the CD sealing members and uniform geometry of the impingement of the CD sealing members.

In use, a control system causes the sealing assembly 260 of the air plenum 202 to be lowered into an operating position. First, the CD sealing members 262 are lowered so that the sealing blades 272 impinge upon the upper support fabric 206 to the degree described above. More particularly, the pressures in the upper and lower loading tubes 230 and 248 are adjusted to cause downward movement of the CD sealing members 262 until movement is halted by the transverse flanges 268 contacting the lower support assemblies 240 or until balanced by fabric tension. Second, the end deckle strips 282 of the MD sealing members 264 are lowered into contact with or close proximity to the upper support fabric. Consequently, the air plenum 202 and vacuum box 204 are both sealed against the wet web to prevent the escape of pressurized fluid.

The air press is then activated so that pressurized fluid fills the air plenum 202 and an air flow is established through the web. In the embodiment illustrated in FIG. 13, high and low vacuums are applied to the high vacuum zones 314, 316, 318 and 320 and the sealing vacuum zones 312 and 322 to facilitate air flow, sealing and water removal. In the embodiment of FIG. 15, pressurized fluid flows from the air plenum to the high vacuum zones 314, 316, 318 and 320 and the deformable sealing deckies 330 seal the air press in the cross machine direction. The resulting pressure differential across the wet web and resulting air flow through the web provide for efficient dewatering of the web.

A number of structural and operating features of the air press contribute to very little pressurized fluid being allowed to escape in combination with a relatively low amount of fabric wear. Initially, the air press 200 uses CD sealing members 262 that impinge upon the fabrics and the wet web. The degree of impingement is determined to maximize the effectiveness of the CD seal. In one embodiment, the air press utilizes the sealing vacuum zones 312 and 322 to create an ambient air flow into the air press across the width of the wet web. In another embodiment, deformable sealing members 330 are disposed in the sealing vacuum zones 312 and 322 opposite the CD sealing members. In either case, the CD sealing members 262 are desirably disposed at least partly in passageways of the vacuum box cover 300 in order to minimize the need for precise alignment of mating surfaces between the air plenum 202 and the vacuum box 204. Further, the sealing assembly 260 can be loaded against a stationary component such as the lower support assemblies 240 that are connected to the frame structure 210. As a result, the loading force for the air press is independent of the pressurized fluid pressure within the air plenum. Fabric wear is also minimized due to the use of low fabric wear materials and lubrication systems. Suitable lubrication systems may include chemical lubricants such as emulsified oils, debonders or other like chemicals, or water. Typical lubricant application methods include a spray of diluted lubricant applied in a uniform manner in the cross machine direction, an hydraulically or air atomized solution, a felt wipe of a more concentrated solution, or other methods well known in spraying system applications.

Observations have shown that the ability to run at higher pressure plenum pressures depends on the ability to prevent leaks. The presence of a leak can be detected from excessive air flows relative to previous or expected operation, additional operating noise, sprays of moisture, and in extreme cases, regular or random defects in the wet web including holes and lines. Leaks can be repaired by the alignment or adjustment of the air press sealing components.

In the air press, uniform air flows in the cross-machine direction are desirable to provide uniform dewatering of a web. Cross-machine direction flow uniformity may be improved with mechanisms such as tapered ductwork on the pressure and vacuum sides, shaped using computational fluid dynamic modeling. Because web basis weight and moisture content may not be uniform in the cross-machine direction, is may be desirably to employ additional means to obtain uniform air flow in the cross-machine direction, such as independently-controlled zones with dampers on the pressure or vacuum sides to vary the air flow based on sheet properties, a baffle plate to take a significant pressure drop in the flow before the wet web, or other direct means. Alternative methods to control CD dewatering uniformity may also include external devices, such as zoned controlled steam showers, for example a Devronizer steam shower available from Honeywell-Measurex Systems Inc. of Dublin, Ohio or the like.

EXAMPLES

The following EXAMPLES are provided to give a more detailed understanding of the invention. The particular amounts, proportions, compositions and parameters are meant to be exemplary, and are not intended to specifically limit the scope of the invention.

As referenced in relation to the Examples, MD Tensile strength, MD Stretch, and CD Tensile strength are obtained according to TAPPI Test Method 494 OM-88 "Tensile Breaking Properties of Paper and Paperboard" using the following parameters: Crosshead speed is 10.0 in/min (254 mm/min); full scale load is 10 lb (4,540 g); jaw span (the distance between the jaws, sometimes referred to as the gauge length) is 2.0 inches (50.8 mm); and specimen width is 3 inches (76.2 mm). The tensile testing machine is a Sintech, Model CITS-2000 from Systems Integration Technology Inc., Stoughton, Mass., a division of MTS Systems Corporation, Research Triangle Park, N.C.

The stiffness of the Example sheets can be objectively represented by either the maximum slope of the machine direction (MD) load/elongation curve for the tissue (hereinafter referred to as the "MD Slope") or by the machine direction Stiffness (herein defined), which further takes into account the caliper of the tissue and the number of plies of the product. Determining the MD Slope will be hereinafter described in connection with FIG. 9. The MD Slope is the maximum slope of the machine direction load/elongation curve for the tissue. The units for the MD Slope are kilograms per 3 inches (7.62 centimeters). The MD Stiffness is calculated by multiplying the MD Slope by the square root of the quotient of the Caliper divided by the number of plies. The units of the MD Stiffness are (kilograms per 3 inches) -microns$^{05}$.

Figure 9:
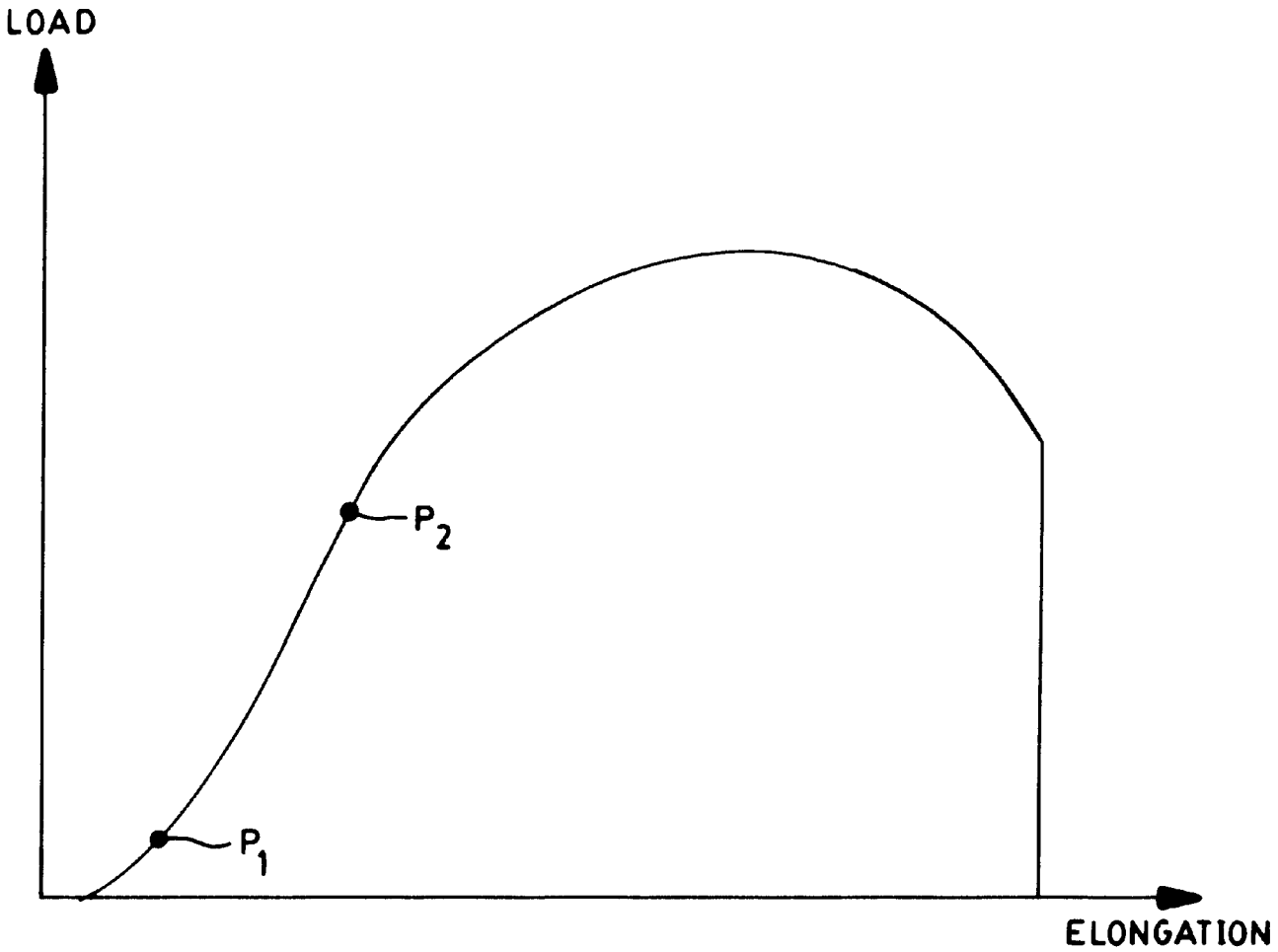
FIG. 9 is a generalized plot of load/elongation curve for tissue, illustrating the determination of the MD Slope.

FIG. 9 is a generalized load/elongation curve for a tissue sheet, illustrating the determination of the MD Slope. As shown, two points P1 and P2, the distance between which is exaggerated for purposes of illustration, are selected that lie along the load/elongation curve. The tensile tester is programmed (GAP [General Applications Program], version 2.5, Systems Integration Technology Inc., Stoughton, Mass.; a division of MTS Systems Corporation, Research Triangle Park, N.C.) such that it calculates a linear regression for the points that are sampled from P1 to P2. This calculation is done repeatedly over the curve by adjusting the points P1 and P2 in a regular fashion along the curve (hereinafter described). The highest value of these calculations is the Max Slope and, when performed on the machine direction of the specimen, will be referred to herein as the MD Slope.

The tensile tester program should be set up such that five hundred points such as P1 and P2 are taken over a two and one-half inch (63.5 mm) span of elongation. This provides a sufficient number of points to exceed essentially any practical elongation of the specimen. With a ten inch per minute (254 mm/min) crosshead speed, this translates into a point every 0.030 seconds. The program calculates slopes among these points by setting the 10th point as the initial point (for example P1), counting thirty points to the 40th point (for example, P2) and performing a linear regression on those thirty points. It stores the slope from this regression in an array. The program then counts up ten points to the 20th point (which becomes P1) and repeats the procedure again (counting thirty points to what would be the 50th point (which becomes P2), calculating that slope and also storing it in the array). This process continues for the entire elongation of the sheet. The Max Slope is then chosen as the highest value from this array. The units of Max Slope are kg per three-inch specimen width. (Strain is, of course, dimensionless since the length of elongation is divided by the length of the jaw span. This calculation is taken into account by the testing machine program.)

Example 1–4.

To illustrate the invention, a number of uncreped throughdried tissues were produced using the method substantially as illustrated in FIG. 1. More specifically, Examples 1–4 were all three-layered, single-ply bath tissues in which the outer layers comprised disperged, debonded eucalyptus fibers and the center layer comprised refined northern softwood kraft fibers. Cenebra eucalyptus fibers were pulped for 15 minutes at 10% consistency and dewatered to 30% consistency. The pulp was then fed to a Maule shaft disperger. The disperger was operated at 160° F. (70° C.) with a power input of 2.2 HPD/T (1.8 kilowatt-days per tonne). Subsequent to disperging, a softening agent (Witco C6027) was added to the pulp in the amount of 7.5 kg per metric ton dry fiber (0.75 weight percent).

Prior to formation, the softwood fibers were pulped for 30 minutes at 3.2 percent consistency, while the disperged, debonded eucalyptus fibers were diluted to 2.5 percent consistency. The overall layered sheet weight was split 35%30%35% for Examples 1, 2 and 4 and 33%34%/33% for Example 3 among the disperged eucalyptus/refined softwood/disperged eucalyptus layers. The center layer was refined to levels required to achieve target strength values, while the outer layers provided softness and bulk. For added dry and temporary wet strength, a strength agent identified as Parez 631 NC was added to the center layer.

These examples employed a four-layer Beloit Concept III headbox. The refined northern softwood kraft stock was used in the two center layers of the headbox to produce a single center layer for the three-layered product described. Turbulence generating inserts recessed about three inches (75 millimeters) from the slice and layer dividers extending about six inches (150 millimeters) beyond the slice were employed. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics being Appleton Mills 2164-B fabrics. Speed of the forming fabric ranged between 11.8 and 12.3 meters per second. The newly-formed web was then dewatered to a consistency of 25–26% using vacuum suction from below the forming fabric without air press, and 32–33% with air press before being transferred to the transfer fabric which was traveling at 9.1 meters per second (29–35% rush transfer). The transfer fabric was Appleton Mills 2164-B. A vacuum shoe pulling about 6–15 inches (150–380 millimeters) of mercury vacuum was used to transfer the web to the transfer fabric.

The web was then transferred to a throughdrying fabric traveling at a speed of about 9.1 meters per second. Appleton Mills T124-4 and T124-7 throughdrying fabrics were used. The web was carried over a Honeycomb throughdryer operating at a temperature of about 350° F. (175° C.) and dried to a final dryness of about 94–98% consistency.

The sequence of producing the Example sheets was as follows: Four rolls of the Example 1 sheets were produced. The consistency data reported in Table 1 is based on 2 measurements, one at the beginning and one at the end of the 4 rolls. The other data shown in Table 1 represents an average based on 4 measurements, one per roll. The air press was then turned on. Data just prior to and just after activation of the air press is shown in Table 3 (individual data points). This data shows that the air press caused significant increases in tensile values. The process was then modified to decrease the tensile values to levels comparable to the Example 1 sheets. After this process adjustment period, four rolls of the Example 2 sheets (this invention) were produced. Later, 4 rolls of the Example 3 sheets (this invention) were produced using a different throughdrying fabric and with the air press activated. The air press was shut off and the process adjusted to regain tensile strength values comparable to the Example 3 sheets. Four rolls of Example 4 sheets were then produced. The consistency data for each Example in Table 2 is an average based on 2 measurements, one at the beginning and one at the end of each set of 4 rolls. The other data in Table 2 is based on an average of 4 measurements per Example sheet, one per roll. In Table 2, the Example 4 data is presented in the left column and the Example 3 data is presented in the right column to remain consistent with Tables 1 and 3, which show data without the air press in the left column and data with the air press in the right column.

Tables 1–3 give more detailed descriptions of the process condition as well as resulting tissue properties for examples 1–4. As used in Tables 1–3 below, the column headings have the following meanings: "Consistency @ Rush Transfer" is the consistency of the web at the point of transfer from the forming fabric to the transfer fabric, expressed as percent solids; "MD Tensile" is the machine direction tensile strength, expressed in grams per 3 inches (7.62 centimeters) of sample width; "CD Tensile" is the cross-machine tensile strength, expressed as grams per 3 inches (7.62 centimeters) of sample width; "MD Stretch" is the machine direction stretch, expressed as percent elongation at sample failure; "MD Slope" is as defined above, expressed as kilograms per 3 inches (7.62 centimeters) of sample width; "Caliper" is the 1 sheet caliper measured with a Bulk Micrometer (TMI Model 49-72-00, Amityville, N.Y.) having an anvil diameter of 4 1/16 inches (103.2 mm) and an anvil pressure of 220 grams/square inch (3.39 Kilo Pascals), expressed in microns; "MD Stiffness" is the Machine Direction Stiffness Factor as defined above, expressed as (kilograms per 3 inches) -microns$^{05}$; "Basis Weight" is the finished basis weight, expressed as grams per square meter; "TAD Fabric" means throughdrying fabric; "Refiner" is power input to refine the center layer, expressed as kilowatts; "Rush" is the difference in speed between the forming fabric and the slower transfer fabric, divided by the speed of the transfer fabric and expressed as a percentage; "HW/SW" is the breakdown of weight of hardwood (HW) and softwood (SW) fibers in the three-layered, single-ply tissues, expressed as a percent of total fiber weight; and "Parez" is the add-on rate of Parez 631 NC expressed as kilograms per metric ton of the center layer fiber.

TABLE 1

| | EXAMPLE 1 (No Air Press) | EXAMPLE 2 (With Air Press and Process Adjustment) |
|---|---|---|
| Consistency @ Rush Transfer (%) | 25.2–26.1 | 32.5–33.4 |
| MD Tensile (grams/3") | 933 | 944 |
| CD Tensile (grams/3") | 676 | 662 |
| MD Stretch (%) | 24.5 | 24.7 |
| MD Slope (kg/3") | 4.994 | 3.778 |
| Caliper (microns) | 671 | 607 |
| MD Stiffness (kg/3"-microns$^{0.5}$) | 129 | 93 |
| Basis Weight (gsm) | 34.6 | 35.2 |
| TAD Fabric | T-124-4 | T-124-4 |
| Refiner (kW) | 32 | 26 |

TABLE 1-continued

| | EXAMPLE 1 (No Air Press) | EXAMPLE 2 (With Air Press and Process Adjustment) |
|---|---|---|
| Rush (%) | 32 | 29 |
| HW/SW (%) | 70/30 | 70/30 |
| Parez (kg/mt) | 4.0 | 3.2 |

TABLE 2

| | EXAMPLE 4 (No Air Press) | EXAMPLE 3 (With Air Press and Process Adjustment) |
|---|---|---|
| Consistency @ Rush Transfer (%) | 24.6 | 32.4 |
| MD Tensile (grams/3") | 961 | 907 |
| CD Tensile (grams/3") | 714 | 685 |
| MD Stretch (%) | 23.5 | 24.4 |
| MD Slope (kg/3") | 5.668 | 3.942 |
| Caliper (microns) | 716 | 704 |
| MD Stiffness (kg/3"-microns$^{0.5}$) | 152 | 105 |
| Basis Weight (gsm) | 35.0 | 35.1 |
| TAD Fabric | T-124-7 | T-124-7 |
| Refiner (kW) | 40 | 34.5 |
| Rush (%) | 35 | 31 |
| HW/SW (%) | 66/34 | 70/30 |
| Parez (kg.mt) | 2.5 | 2.5 |

TABLE 3

| | (No Air Press) | (With Air Press) |
|---|---|---|
| Consistency @ Rush Transfer (%) | 25.2 | 32.5 |
| MD Tensile (grams/3") | 915 | 1099 |
| CD Tensile (grams/3") | 661 | 799 |
| CD Wet Tensile | 127 | 150 |
| MD Stretch (%) | 24.4 | 28.5 |
| MD Slope (kg/3") | 4.996 | 4.028 |
| Caliper (microns) | 665 | 630 |
| MD Stiffness (kg/3"-microns$^{0.5}$) | 129 | 101 |
| Basis Weight (gsm) | 34.3 | 34.6 |
| TAD Fabric | T-124-4 | T-124-4 |
| Refiner (kW) | 32 | 32 |
| Rush (%) | 32 | 32 |
| HW/SW (%) | 70/30 | 70/30 |
| Parez (kg/mt) | 4.0 | 4.0 |

As shown by the previous Examples, the air press produces significantly higher consistencies upstream of the differential speed transfer which result in softer sheets as evidenced by lower modulus values. Desirably, the modulus (MD Stiffness) of tissue products is at least 20 percent less than that of a comparable tissue product made without supplementally dewatering to a consistency of greater than about 30 percent. Further, the machine direction tensile of the tissue products is at least 20 percent greater, and the cross direction tensile of the tissue products is at least 20 percent greater, than that of a comparable tissue product made without supplementally dewatering to a consistency of greater than about 30 percent. Additionally, the machine direction stretch of tissue products is at least 17 percent greater than that of a comparable tissue product made without supplementally dewatering to a consistency of greater than about 30 percent.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various process and equipment arrangements as disclosed in U.S. Pat. No. 5,667,636 issued Sep. 16, 1997 to S. A. Engel et al., may be employed. Therefore, the invention should not be limited by the specific embodiments described, but only by the claims.

We claim:

1. A method for making a creped throughdried web, comprising:

(a) depositing an aqueous suspension of papermaking fibers onto an endless forming fabric to form a wet web;

(b) dewatering the wet web to a consistency of about 30 percent or greater using a noncompressive dewatering device comprising an air plenum and a collection device that is adapted to cause a pressurized fluid at about 5 pounds per square inch gauge or greater to flow substantially through the web due to an integral seal formed between said air plenum and said collection device, wherein about 70 percent or greater of the pressurized fluid supplied to the air plenum passes through the wet web;

(c) transferring the wet web to a throughdrying fabric;

(d) throughdrying the noncompressively dewatered web;

(e) transferring the throughdried web onto the surface of a drying cylinder; and (f) removing the throughdried web from the drying cylinder with a creping blade.

2. A method for making a creped throughdried web, comprising:

(a) depositing an aqueous suspension of papermaking fibers onto an endless forming fabric to form a wet web;

(b) dewatering the wet web to a consistency of about 10 to about 30 percent;

(c) supplementally dewatering the wet web to a consistency of about 30 to about 40 percent using an air press that is adapted to cause a pressurized fluid at about 5 pounds per square inch gauge or greater to flow substantially through the web due to an integral seal formed between an air plenum and a collection device wherein about 70 percent or greater of the pressurized fluid supplied to the air plenum passes through the wet web;

(d) transferring the wet web to a throughdrying fabric;

(e) throughdrying the noncompressively dewatered web;

(f) transferring the throughdried web onto the surface of a drying cylinder; and (g) removing the throughdried web from the drying cylinder with a creping blade.

3. A method for making a creped throughdried web, comprising:

(a) depositing an aqueous suspension of papermaking fibers onto an endless forming fabric to form a wet web;

(b) sandwiching the wet web between a pair of fabrics;

(c) passing the sandwiched wet web structure between an air plenum and a collection device, the air plenum and collection device being operatively associated integrally sealed such that about 70 percent or greater of a pressurized fluid supplied to the air plenum passes through the wet web, and adapted to create a pressure differential across the wet web of about 30 inches of mercury or greater and a stream of pressurized fluid through the wet web of about 10 standard cubic feet per minute per square inch or greater;

(d) dewatering the wet web using the stream of pressurized fluid to a consistency of about 30 percent or greater;

(e) transferring the wet web to a throughdrying fabric;

(f) throughdrying the noncompressively dewatered web;

(g) transferring the throughdried web onto the surface of a drying cylinder; and (h) removing the throughdried web from the drying cylinder with a creping blade.

4. The method of claim 1, wherein the noncompressive dewatering device increases the consistency of the web by from about 5 to about 20 percent.

5. The method of claim 2, wherein the web is supplementally dewatered to a consistency of about 32 percent or greater.

6. The method of claim 5, wherein the web is supplementally dewatered to a consistency of about 34 percent or greater.

7. The method of claim 1, 2 or 3, wherein the pressure differential across the web is from about 35 to about 60 inches of mercury.

8. The method of claim 1, 2 or 3, wherein the pressurized fluid is pressurized to about 5 to about 30 pounds per square inch gauge.

9. The method of claim 1, 2 or 3, wherein the collection device comprises a vacuum box that draws a vacuum of greater than 0 to about 25 inches of mercury.

10. The method of claim 2 or 3, wherein the dwell time in the air press is about 10 or less.

11. The method of claim 10, wherein the dwell time in the air press is about 7.5 or less.

12. The method of claim 2, wherein the web is dewatered to a consistency of about 10 to about 30 percent prior to the air press using one or more vacuum boxes.

13. The method of claim 2 or 3, wherein about 85 percent or greater of the pressurized fluid fed to the air plenum flows through the wet web.

14. The method of claim 13, wherein about 90 percent or greater of the pressurized fluid fed to the air plenum flows through the wet web.

15. The method of claim 1, 2 or 3, wherein the temperature of the pressurized fluid is about 300 degrees Celsius or less.

16. The method of claim 15, wherein the temperature of the pressurized fluid is about 150 degrees Celsius or less.

17. A tissue sheet made by the method of claim 1, 2 or 3.

* * * * *